US011846128B2

(12) United States Patent
Cheever et al.

(10) Patent No.: US 11,846,128 B2
(45) Date of Patent: Dec. 19, 2023

(54) DOOR SECURITY DEVICE

(71) Applicants: Alan D. Cheever, Overbrook, KS (US); Dustin Ryan Rojohn, Gardner, KS (US)

(72) Inventors: Alan D. Cheever, Overbrook, KS (US); Dustin Ryan Rojohn, Gardner, KS (US)

( * ) Notice: Subject to any disclaimer, the term of this patent is extended or adjusted under 35 U.S.C. 154(b) by 1055 days.

(21) Appl. No.: 16/511,989

(22) Filed: Jul. 15, 2019

(65) Prior Publication Data

US 2019/0338572 A1 Nov. 7, 2019

Related U.S. Application Data

(63) Continuation-in-part of application No. 29/646,769, filed on May 7, 2018, now Pat. No. Des. 853,832, which is a continuation of application No. 15/040,683, filed on Feb. 10, 2016, now Pat. No. 9,963,920.

(60) Provisional application No. 62/176,195, filed on Feb. 11, 2015, provisional application No. 62/176,154, filed on Feb. 10, 2015.

(51) Int. Cl.
*E05C 17/54* (2006.01)
*E05C 19/18* (2006.01)

(52) U.S. Cl.
CPC ..... *E05C 17/54* (2013.01); *E05C 19/184* (2013.01); *Y10S 292/15* (2013.01); *Y10T 292/11* (2015.04); *Y10T 292/71* (2015.04)

(58) Field of Classification Search
CPC ..... E05C 17/54; E05C 19/184; Y10T 292/11; Y10T 292/71; Y10S 292/15
See application file for complete search history.

(56) References Cited

U.S. PATENT DOCUMENTS

| | | | | | |
|---|---|---|---|---|---|
| 177,102 | A | * | 5/1876 | Daniels | E05C 17/54 292/343 |
| 1,037,439 | A | * | 9/1912 | Coffin | E05C 19/18 292/288 |
| 1,119,650 | A | | 12/1914 | Smith | |
| 1,351,453 | A | * | 8/1920 | Wells, Jr. | E06B 3/44 428/156 |
| 1,354,046 | A | * | 9/1920 | Lanning | E05C 17/54 292/343 |
| 1,493,926 | A | | 11/1923 | Emslie | |
| 1,939,402 | A | * | 12/1933 | Moser | E05C 17/54 16/86 A |
| 2,122,312 | A | | 6/1938 | Cassion | |
| 3,833,963 | A | | 9/1974 | Waters | |
| 3,977,714 | A | | 8/1976 | Trotter | |

(Continued)

FOREIGN PATENT DOCUMENTS

| | | |
|---|---|---|
| DE | 333282 C | 2/1921 |
| DE | 29711966 U1 | 10/1997 |

(Continued)

*Primary Examiner* — Mark A Williams
(74) *Attorney, Agent, or Firm* — AVEK IP, LLC

(57) ABSTRACT

A door lock has a bottom surface, a bottom surface, a wedge portion extending upward from the bottom surface, and a projection member secured to the bottom surface. The projection member has a plurality of spikes defined therein that extend from a first side of the projection member in a direction away from the bottom surface.

17 Claims, 25 Drawing Sheets

(56) References Cited

U.S. PATENT DOCUMENTS

| | | | | |
|---|---|---|---|---|
| 4,230,353 | A * | 10/1980 | Bjorgum | E05C 17/54 292/343 |
| 5,163,308 | A | 11/1992 | Lillo | |
| 5,199,759 | A | 4/1993 | Anderson | |
| 5,383,254 | A | 1/1995 | Wigley | |
| 5,454,610 | A | 10/1995 | Taylor et al. | |
| 5,456,506 | A | 10/1995 | Bartlett | |
| 5,711,560 | A | 1/1998 | Gilbertson | |
| 5,826,850 | A | 10/1998 | Goldsmith | |
| 5,836,049 | A | 11/1998 | Chiang | |
| 6,161,252 | A | 12/2000 | Rodrigues | |
| 6,345,849 | B1 | 2/2002 | Yen | |
| 6,557,912 | B1 | 5/2003 | Truong | |
| 7,651,140 | B2 | 1/2010 | Leggio | |
| 8,191,191 | B2 * | 6/2012 | Montross | A47C 20/021 5/660 |
| 8,727,400 | B1 | 5/2014 | Marchand | |
| D717,641 | S | 11/2014 | Hugo | |
| D731,273 | S * | 6/2015 | McPeak Ford | D8/402 |
| D733,520 | S | 7/2015 | Barna | |
| D762,464 | S * | 8/2016 | Peterson | D8/402 |
| 9,644,407 | B1 * | 5/2017 | Abramovits | E05C 17/54 |
| D813,642 | S | 3/2018 | Tyus | |
| 10,760,309 | B1 * | 9/2020 | Bowman | E05C 17/54 |
| D924,675 | S * | 7/2021 | Potter | D8/402 |
| 2011/0254293 | A1 * | 10/2011 | Duff | E05C 17/54 292/343 |
| 2012/0080891 | A1 | 4/2012 | Bravo | |
| 2014/0001775 | A1 | 1/2014 | Mullenbach | |
| 2014/0312634 | A1 | 10/2014 | Cushwa, Jr. et al. | |

FOREIGN PATENT DOCUMENTS

| | | | |
|---|---|---|---|
| FR | 2729705 | A1 | 7/1996 |
| GB | 2030639 | A | 4/1980 |
| JP | 5330665 | A | 11/1994 |

* cited by examiner

DOOR SECURITY DEVICE

CROSS-REFERENCE TO RELATED APPLICATIONS

This application is a continuation-in-part of U.S. Design patent application Ser. No. 29/646,769, filed May 7, 2018, and which is a continuation of U.S. patent application Ser. No. 15/040,683, filed Feb. 10, 2016, which was granted as U.S. Pat. No. 9,963,920 on May 8, 2018, and which claims the benefit of priority to U.S. Provisional Application No. 62/176,154 filed Feb. 10, 2015, and U.S. Provisional Application No. 62/176,195 filed Feb. 11, 2015, the contents of each of which are incorporated herein in their entirety by reference.

BACKGROUND

Security issues in both public and private buildings have become widespread in recent years, as is evidenced by shootings at Sandy Hook, Virginia Tech, San Bernardino, and many other locations. With door locks, occupants benefit from an additional safety measure to prevent undesired and sometimes lethal entry into a room.

The door locks disclosed herein may transform a classroom, office, or other location into a safe room if used when a suspected intruder is nearby, and a user may only need to apply a small amount of effort to transform a room into a safe room; thus averting injury or possible death of the room's occupants.

The present disclosure relates generally to door locks and, more specifically, to door locks that interact with a floor to prevent entry through a door.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In one embodiment, a door lock includes a base, a wedge, and two pins. The base has an abutting end and an engaging end, the engaging end being wider than the abutting end and having two holes where an outermost edge of each of the base holes is laterally outside opposite sides of the wedge. The wedge extends upwardly from the base and has a tapered end that is generally adjacent the abutting end of the base. The pins are configured to pass through the holes in the base and apertures in a floor surface to temporarily secure the base to the floor surface.

In another embodiment, a door lock includes a base, a wedge, two pins, and a magnet. The base has an abutting end and an engaging end, the engaging end being wider than the abutting end and having two holes. The wedge extends upwardly from the base, and a tapered end of the wedge is generally adjacent the abutting end of the base. The two pins are coupled to one another and are each configured to pass through a base hole and an aperture in the floor surface to secure the base to the floor. The magnet imparts a magnetic field above the base engaging end to selectively bias the pins to the base. The wedge is positioned between the pins when the pins are biased to the base by the magnetic force.

According to still another embodiment, a door lock has a bottom surface, a wedge portion extending upward from the bottom surface, and a projection member secured to the bottom surface. The wedge portion includes an angled top surface, opposing angled sides extending from the angled top surface to the bottom surface, and a substantially vertical back wall. A horizontal member extends perpendicularly from the back wall, and a handle extends upwardly from the horizontal member at an end of the horizontal member. The projection member has a plurality of spikes defined therein which extend from a first side of the projection member in a direction away from the bottom surface.

In a further embodiment, a door lock has a bottom surface, a wedge portion extending upward from the bottom surface, and a projection member secured to the bottom surface. The projection member has a plurality of spikes defined therein that extend from a first side of the projection member in a direction away from the bottom surface.

According to still yet another embodiment, a method for preventing a door from opening includes identifying an area of a floor surface at a side of a closed door corresponding to a direction of travel of the door, positioning a door lock at the area of the floor surface such that the door lock is substantially adjacent the door, and pressing down on the door lock such that the plurality of spikes engages with the floor surface. The door lock includes a wedge portion extending upward from a bottom surface, and a projection member secured to the bottom surface, which includes a plurality of spikes that extend from a first side of the projection member in a direction away from the bottom surface.

DETAILED DESCRIPTION

Figure 1:
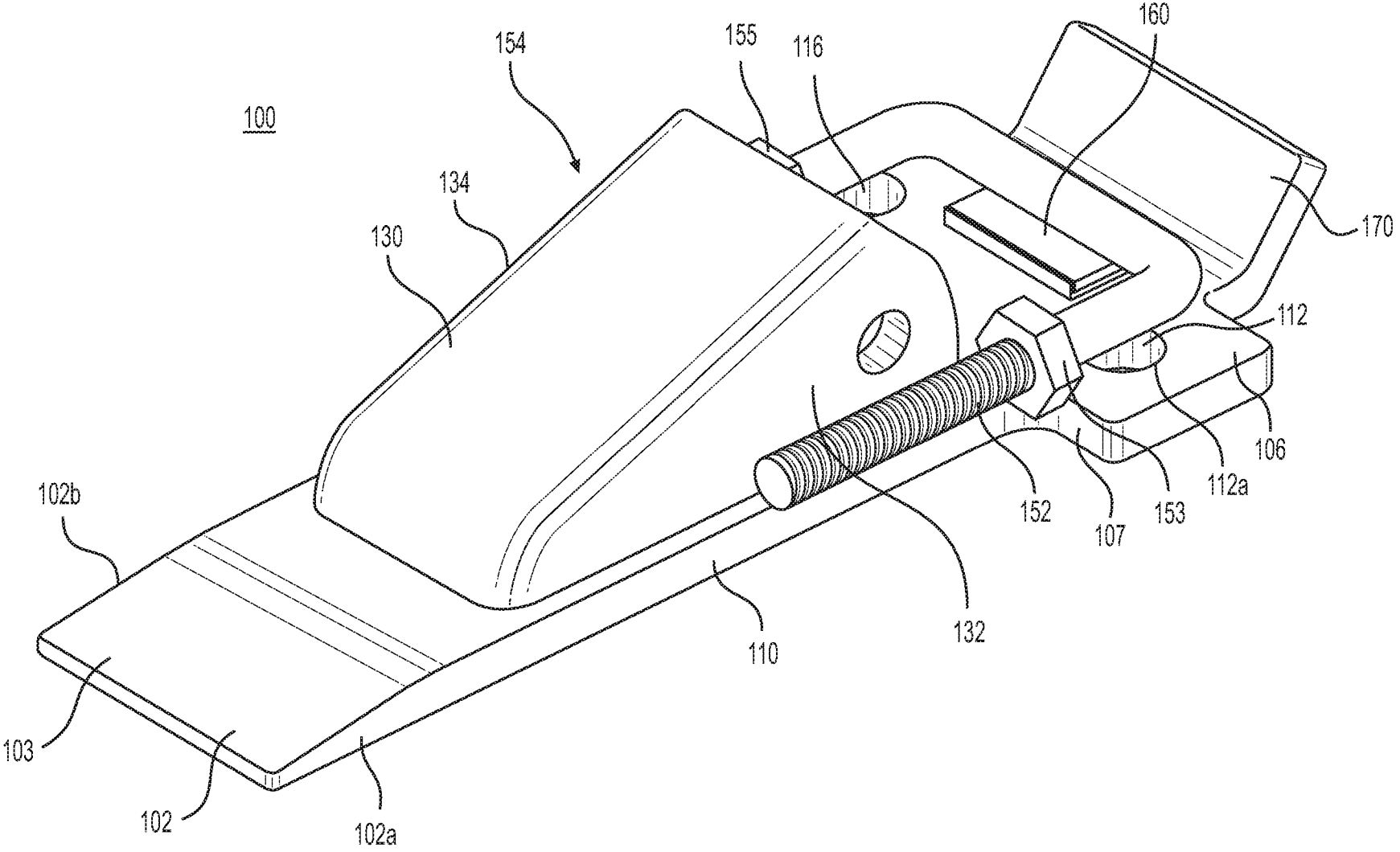
FIG. 1 is a perspective view of a door lock, showing the pins biased to the base.

FIGS. 1 through 10 show a door lock 100 according to embodiments of the current invention. The door lock 100 broadly includes a base 110, a wedge 130, and two pins 152, 154.

As shown in FIG. 1, the base 110 has an abutting end 102 and an engaging end 106. The abutting end 102 has opposite sides 102*a*, 102*b* which may be generally parallel to one another, and the abutting end 102 may have a taper 103. The engaging end 106 is wider than the abutting end 102 and extends outwardly from the sides 102*a*, 102*b* of the abutting end 102. The engaging end 106 may have a forward edge 107 that is generally perpendicular to the opposite sides 102*a*, 102*b* of the abutting end 102.

Figure 2:
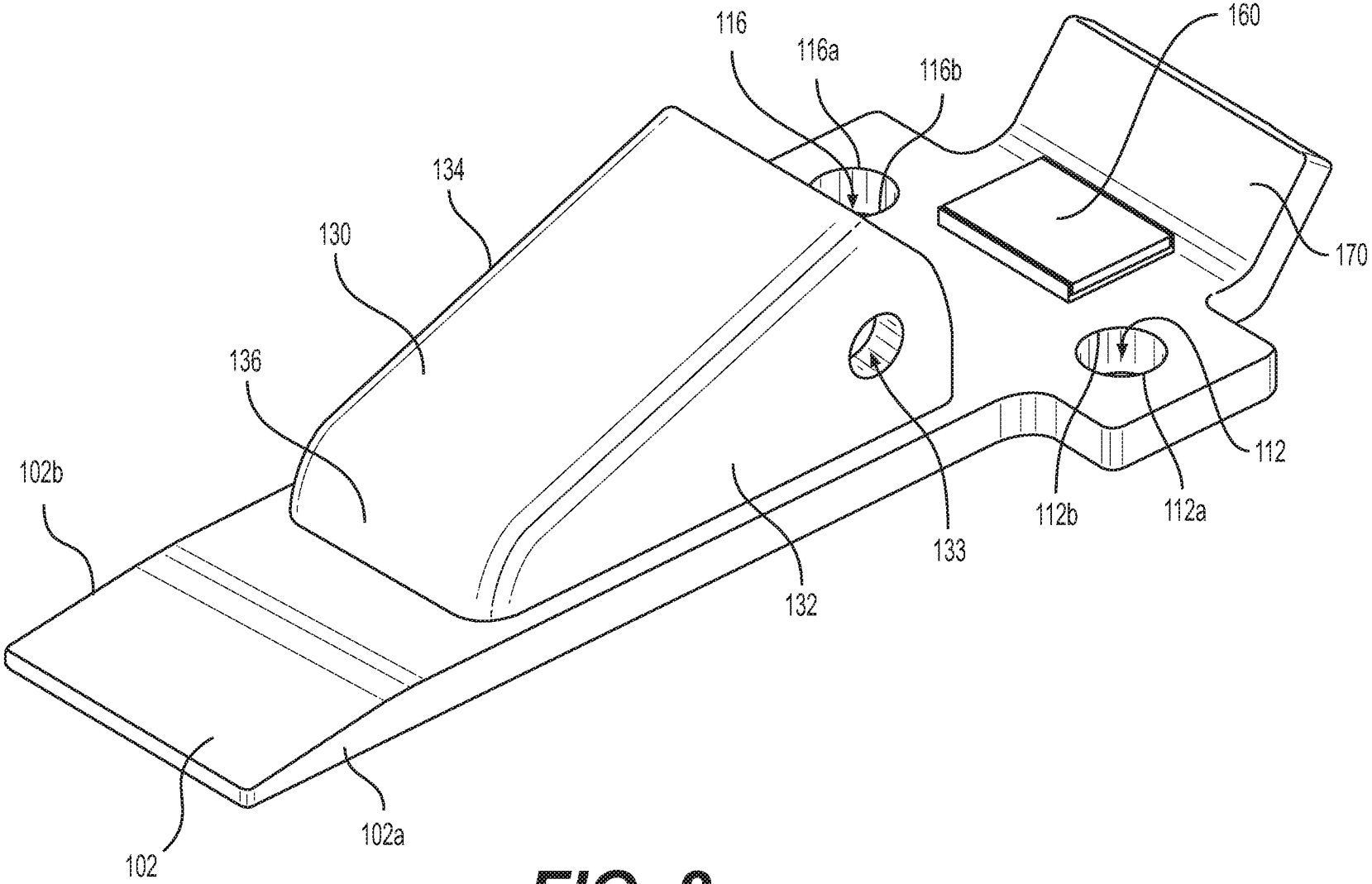
FIG. 2 is a perspective view of the door lock of FIG. 1, shown without the pins.
Figure 3:
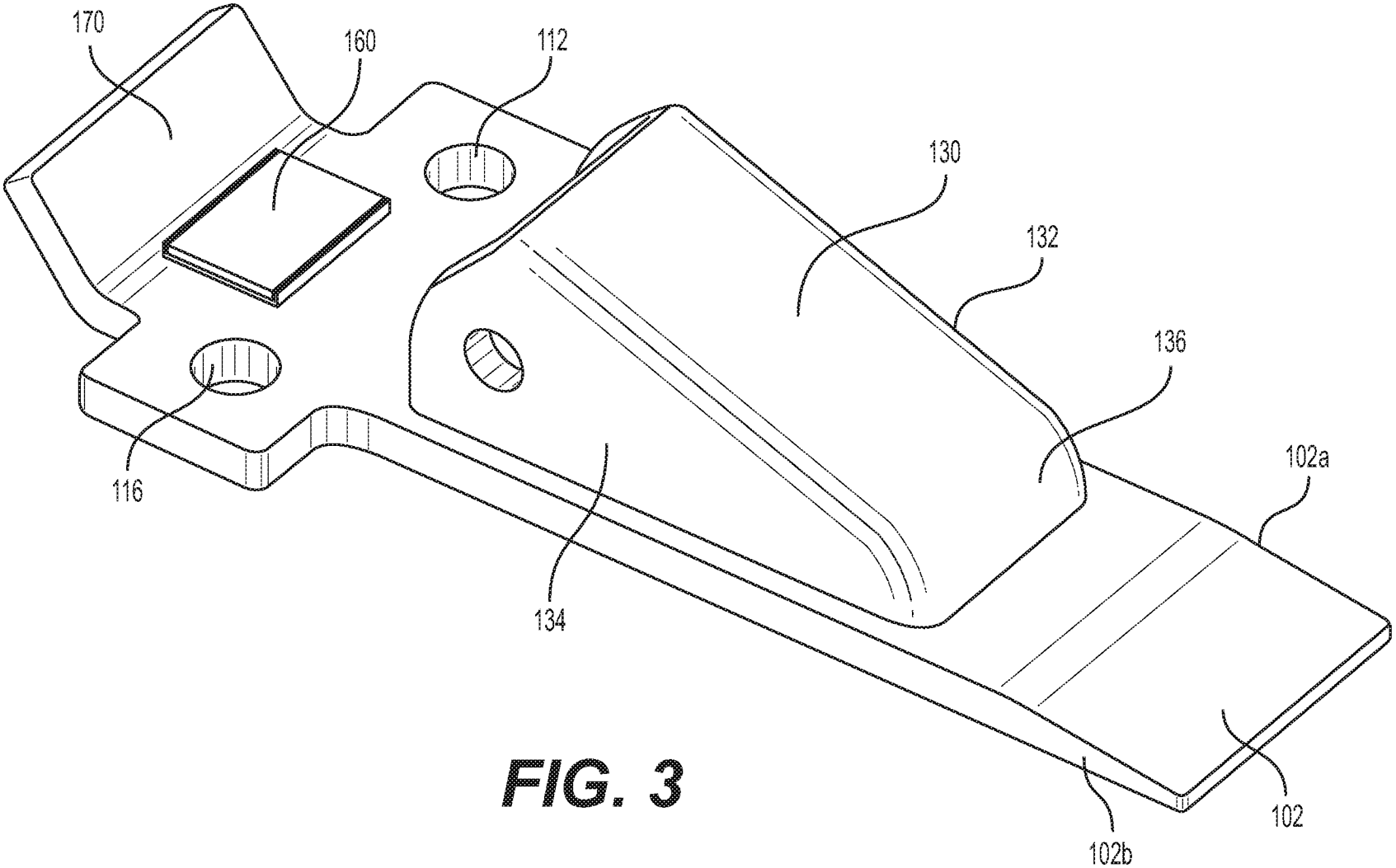
FIG. 3 is another perspective view of the door lock of FIG. 1.
Figure 4:
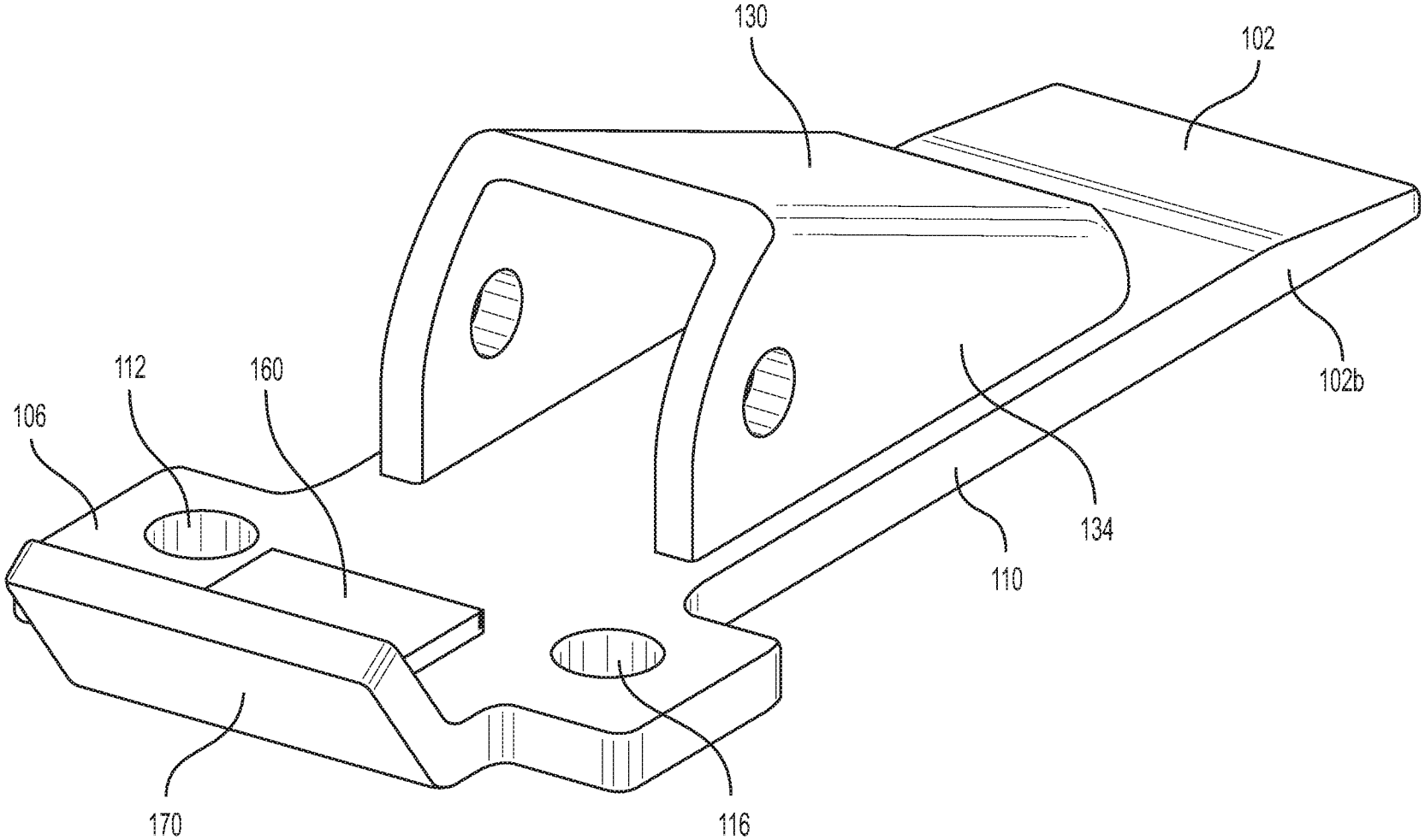
FIG. 4 is yet another perspective view of the door lock of FIG. 1.
Figure 5:
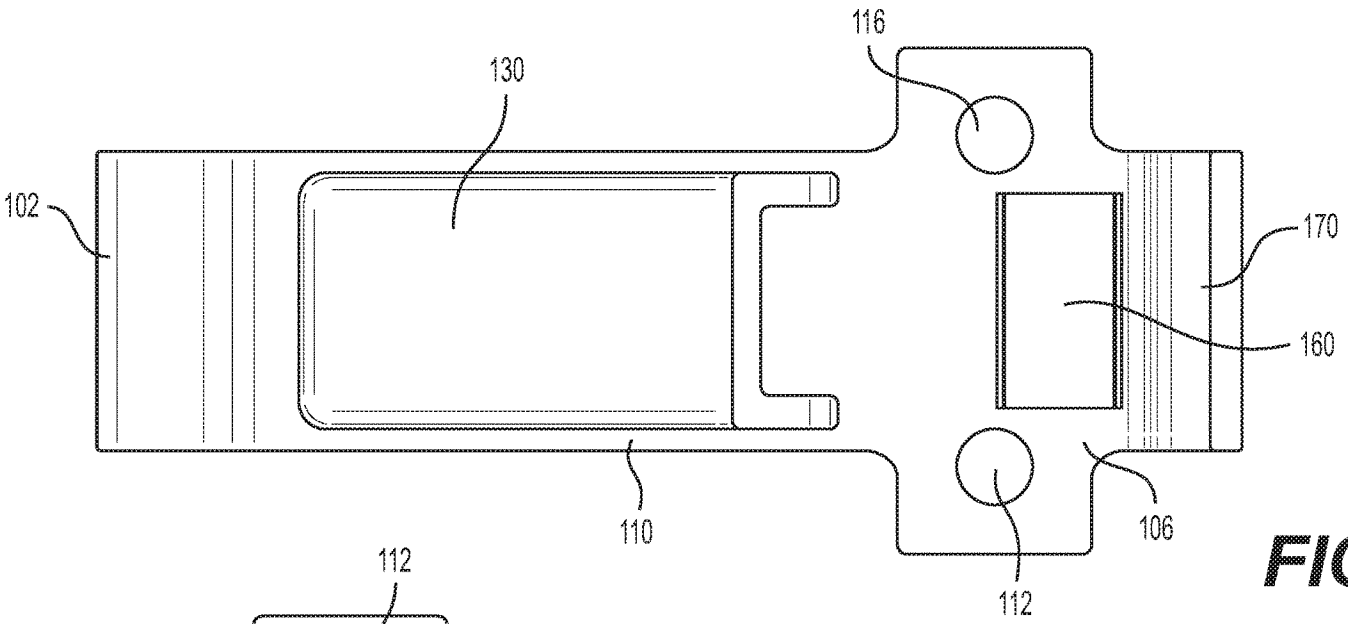
FIG. 5 is a top view of the door lock of FIG. 1.
Figure 6:
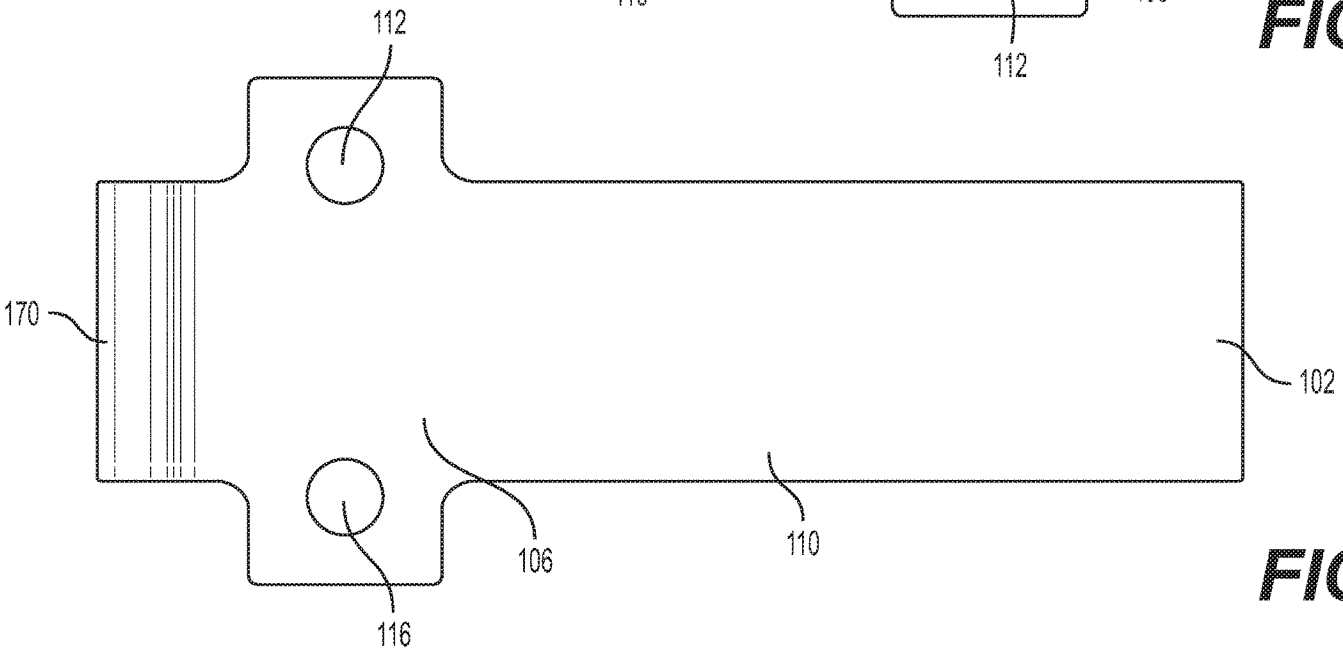
FIG. 6 is a bottom view of the door lock of FIG. 1.
Figure 7:
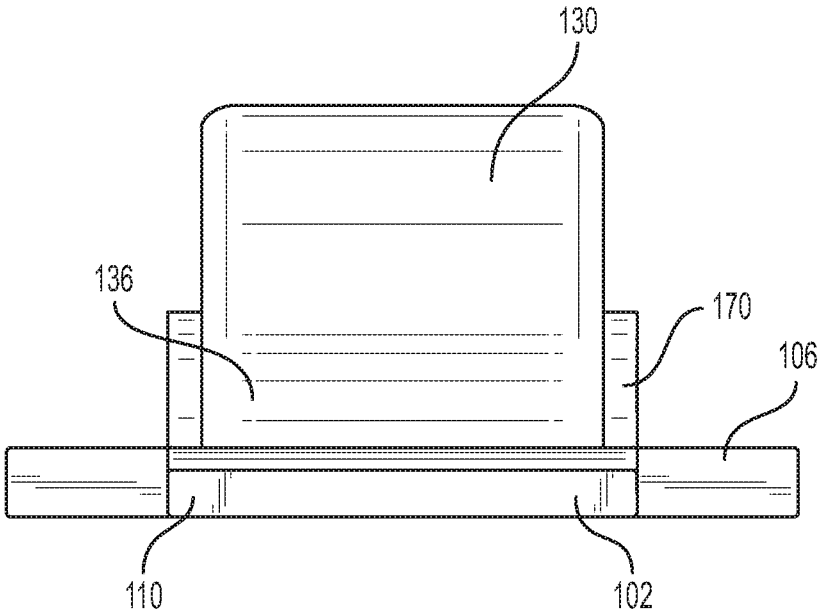
FIG. 7 is a front view of the door lock of FIG. 1.
Figure 8:
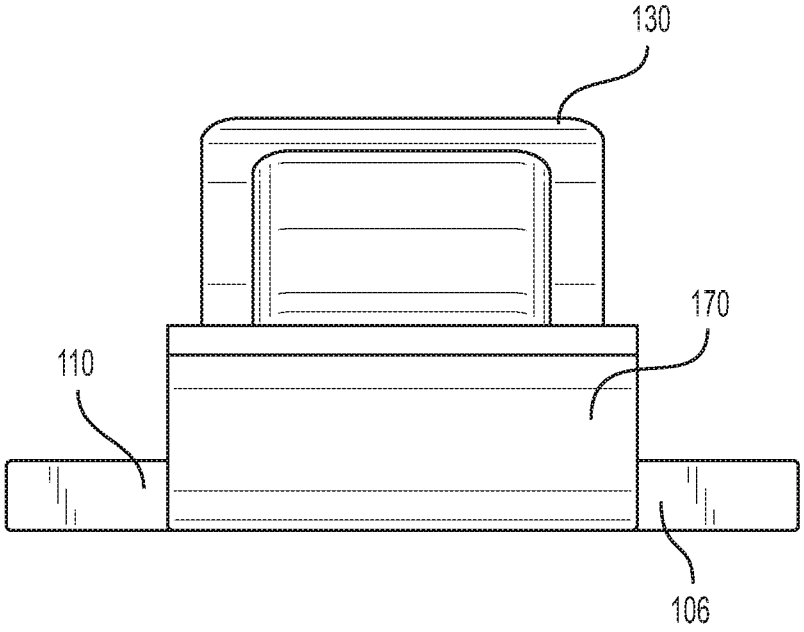
FIG. 8 is a back view of the door lock of FIG. 1.
Figure 9:
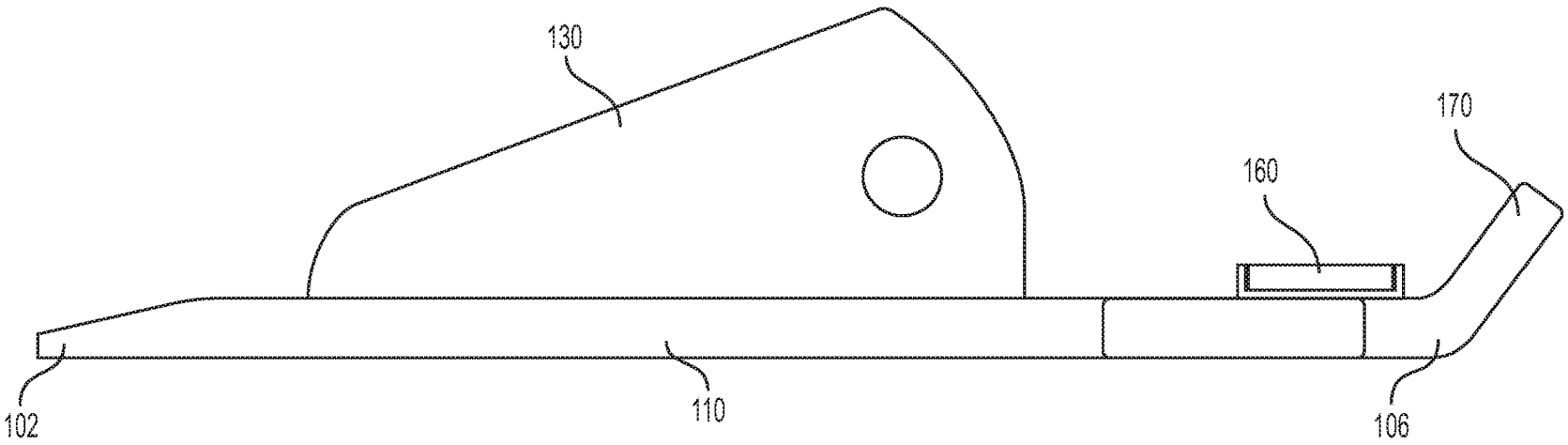
FIG. 9 is a side view of the door lock of FIG. 1.
Figure 10:
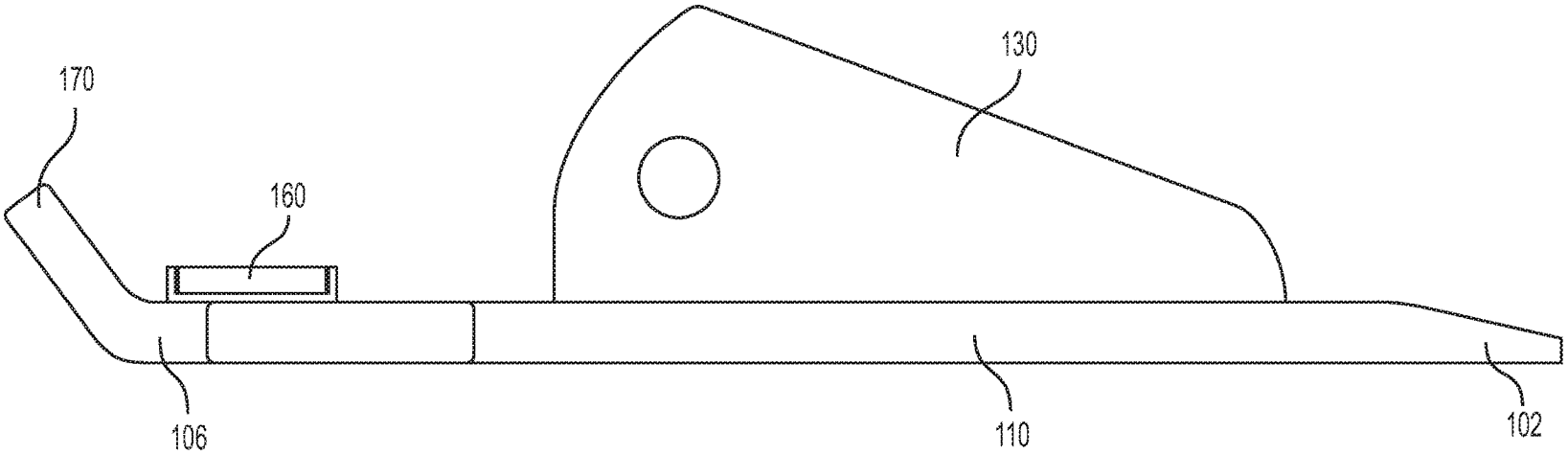
FIG. 10 is an opposite side view of the door lock of FIG. 1.

As shown in FIG. 2, two holes 112, 116 are disposed in the engaging end 106. An outermost edge 112*a*, 116*a* of each hole 112, 116 may be outside opposite sides 132, 134 of the wedge 130 and outside the opposite sides 102*a*, 102*b* of the base abutting end 102. An innermost edge 112*b*, 116*b* of each hole 112, 116 may be inside the opposite sides 102*a*, 102*b* of the base abutting end 102. The base 110 may be constructed of any appropriate material, such as steel, aluminum, and other metals and composites.

Turning to the wedge 130, the tapered end 136 of the wedge 130 is generally adjacent the taper 103 of the abutting end 102 of the base 110. It may be particularly desirable for the wedge 130 to be hollow, and apertures 133, 135 in the wedge sides 132, 134 may reduce a weight of the wedge 130 and serve as attachment points whereby items may be tethered to the wedge 130. The wedge may be constructed of any appropriate material, such as steel, aluminum, and other materials and composites. The wedge 130 may be attached to the base 110 (e.g., by adhesive, welding, bolting, etc.) or may be formed integrally with the base 110.

Figure 13:
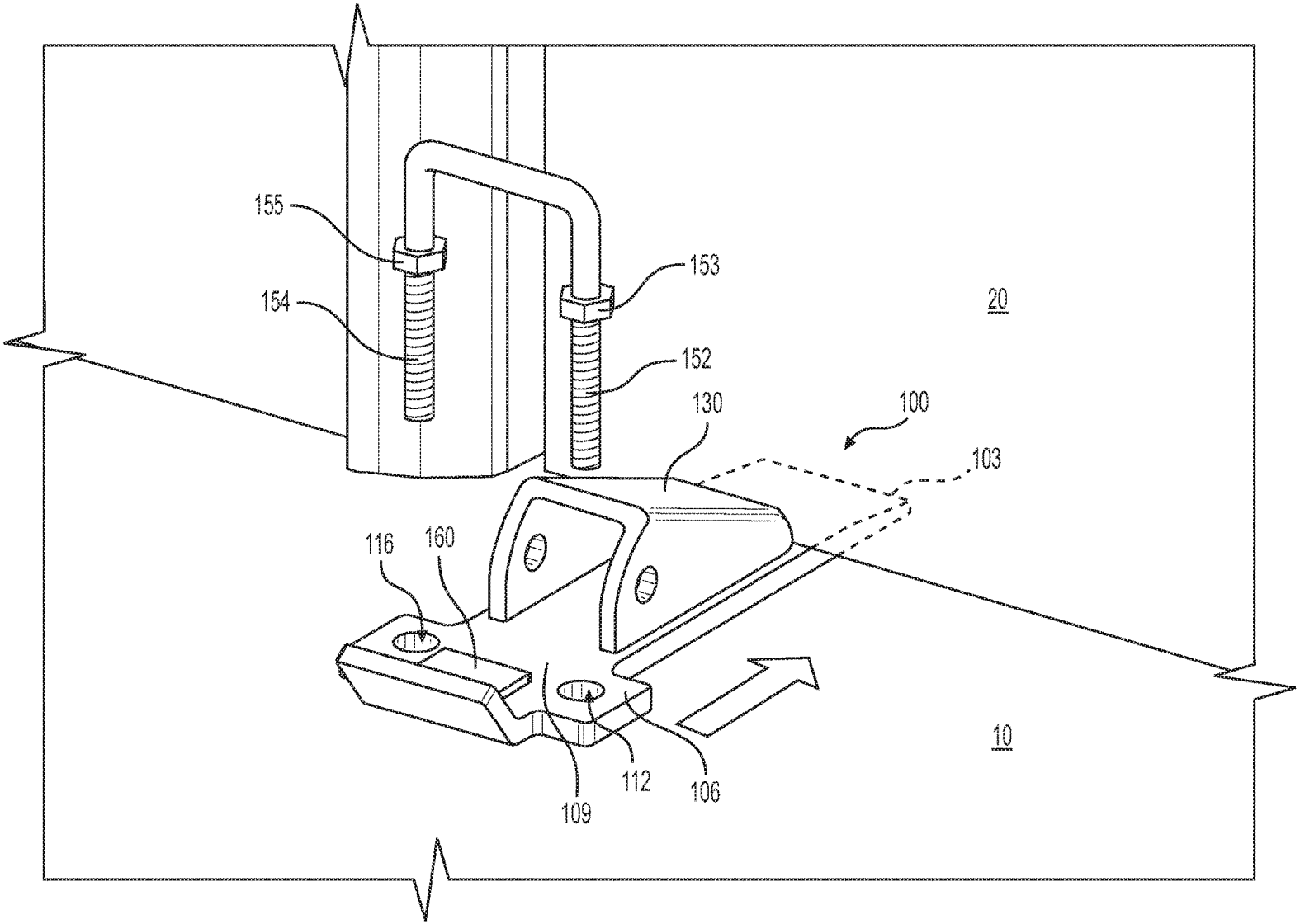
FIG. 13 is a perspective view showing the door lock of FIG. 1 interacting with the door and the floor, with the pins positioned above the door lock.

The pins 152, 154 (FIGS. 1, 13, 14) are configured to pass through the holes 112, 116 and respective apertures 12, 16 in a floor surface 10 to secure the base 110 to the floor surface 10. As shown in FIG. 13, the pins 152, 154 may be coupled to one another, such as in a U-shape as shown. Stops 153, 155 may be configured to interact with an upper surface 109 of the base engaging end 106 without passing through the holes 112, 116, which in turn limits an amount of travel for the pins 152, 154 into the holes 112, 116 and the floor apertures 12, 16.

Steel sleeves may be placed in the floor apertures 12, 16 to secure the apertures 12, 16 and provide an interior for engaging with the pins 152, 154. The steel sleeves may further aid in keeping the pins 152, 154 secure when engaged with the floor surface 10. Caps or other covers may overlay the steel sleeves when the pins 152, 154 are not engaged to keep dirt and debris from entering the sleeves so that the apertures 12, 16 remain clear. Use of the steel sleeves may be preferable to other methods or ways of securing the apertures 12, 16, such as a floor plate. The steel sleeves may be easier to install, more cost effective, require fewer materials, and maintain a clear walkway through the door.

The door lock 100 may also have a magnet 160. As shown in FIG. 2, the magnet 160 is fixed to the engaging end 106 of the base 110 (e.g. between the two holes 112, 116). As shown in FIG. 1, the magnet 160 may be used to bias the pins 152, 154 to the base 110 using a magnetic field when the pins 152, 154 are not engaged with the floor surface 10. This allows for easy storage of the door lock 100, and aids in preventing loss or misplacement of the pins 152, 154. Having the pins 152, 154 biased to the base 110 with the magnet 160 also allows for rapid engagement of the door lock 100, as the base 110 and the pins 152, 154 are not stored in two separate places and may be separated only during the moments preceding engagement. The magnetic field caused by the magnet 160 may interact with the stops 153, 155 and bias the pins 152, 154 to the base 110 while the pins 152, 154 are engaged with the base 110 to temporarily secure the base 110 to the floor surface 10. The magnet 160 may be round, square, rectangular, triangular, or any other desired shape. The magnet 160 may be attached to the base 110 by adhesive, bolting, welding, or any appropriate method known in the art, whether now known or later developed. The handle 170 may preferably extend above the magnet 160 and below an uppermost point of the wedge 130. In one embodiment, the handle 170 is between one half and three inches long. The handle 170 may extend upwardly and outwardly from the base 110 at an angle between twenty-five and eighty-five degrees from horizontal. It may be desirable for the handle 170 to extend upwardly and outwardly from the base 110 at an angle between forty-five and seventy-five degrees from horizontal, and even more desirable for the handle 170 to extend upwardly and outwardly from the base 110 at an angle of about sixty degrees from horizontal. A width of the handle 170 may be less than a width of the base engaging end 106, such that the handle 170 does not extend along the entire width of the base engaging end 106. The handle 170 may be constructed of any appropriate material, such as steel, aluminum, and other metals and composites. The handle 170 may be attached to the base 110 (e.g., by adhesive welding, bolting, etc.) or may be formed integrally with the base 110.

Figure 11:
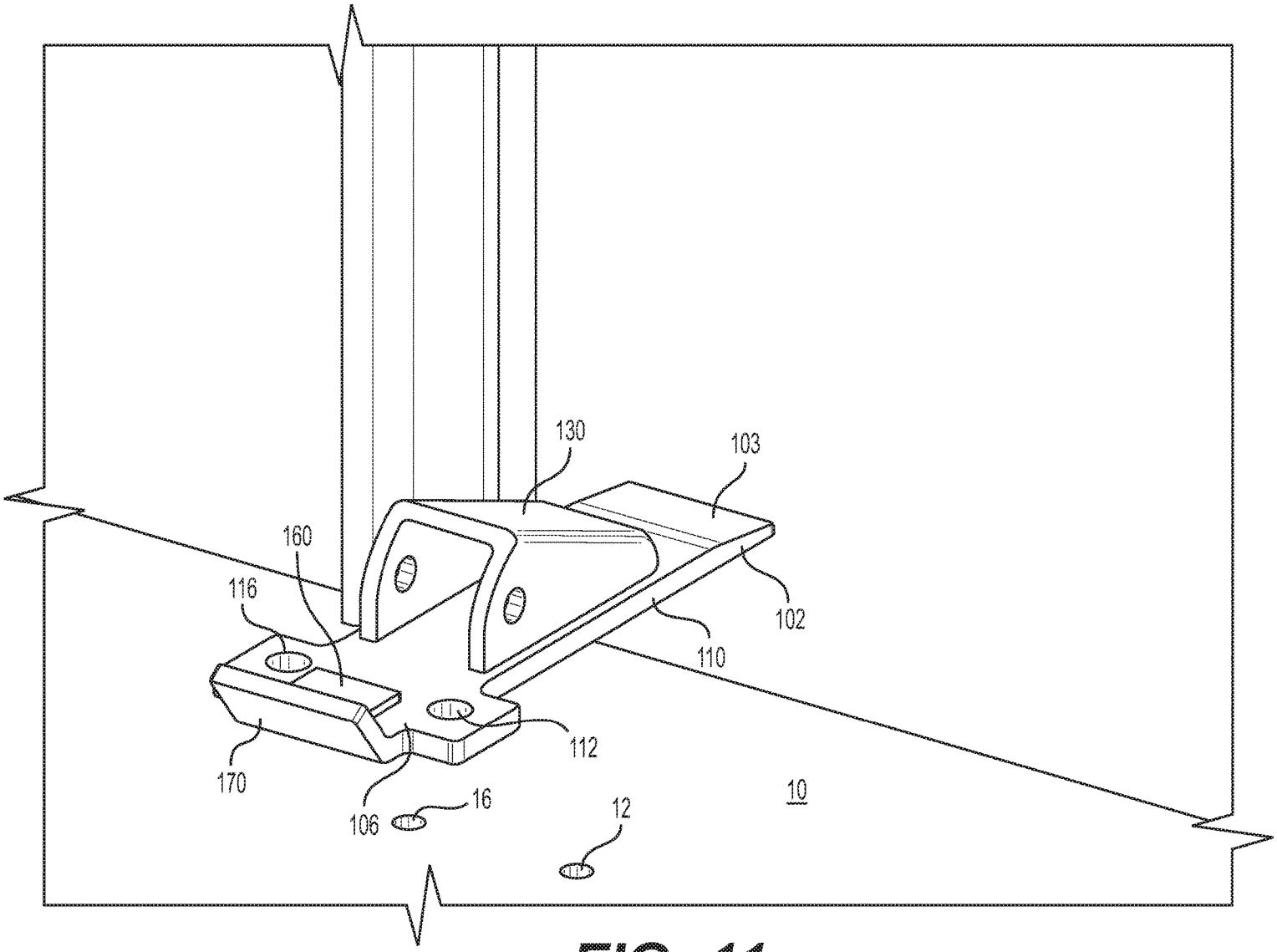
FIG. 11 is a perspective view showing the door lock of FIG. 1 with a door and a floor surface.
Figure 12:
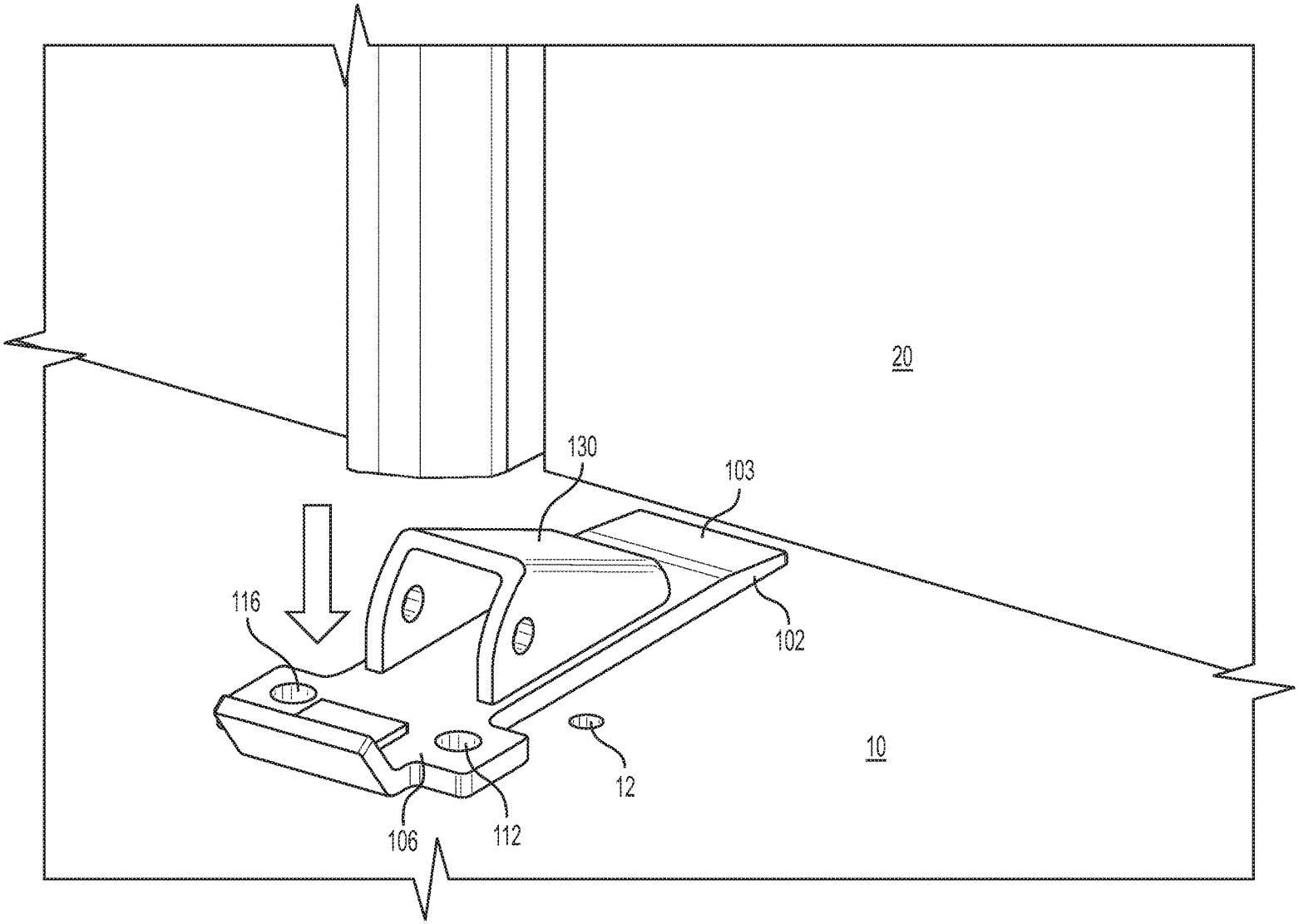
FIG. 12 is another perspective view showing the door lock of FIG. 1 being lowered to the floor surface.
Figure 14:
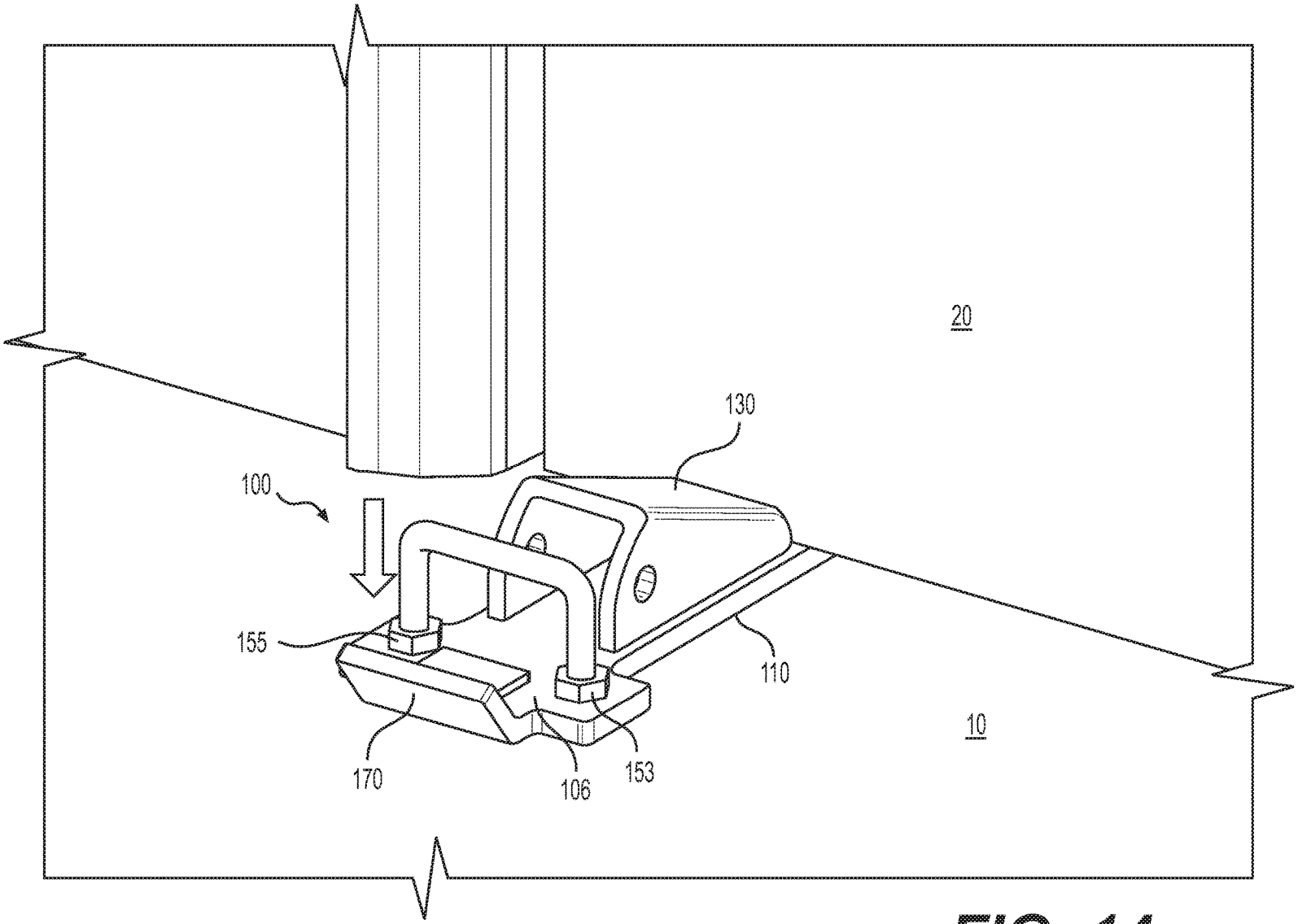
FIG. 14 is a perspective view showing the door lock of FIG. 1 in use with the pins engaged.
Figure 15:
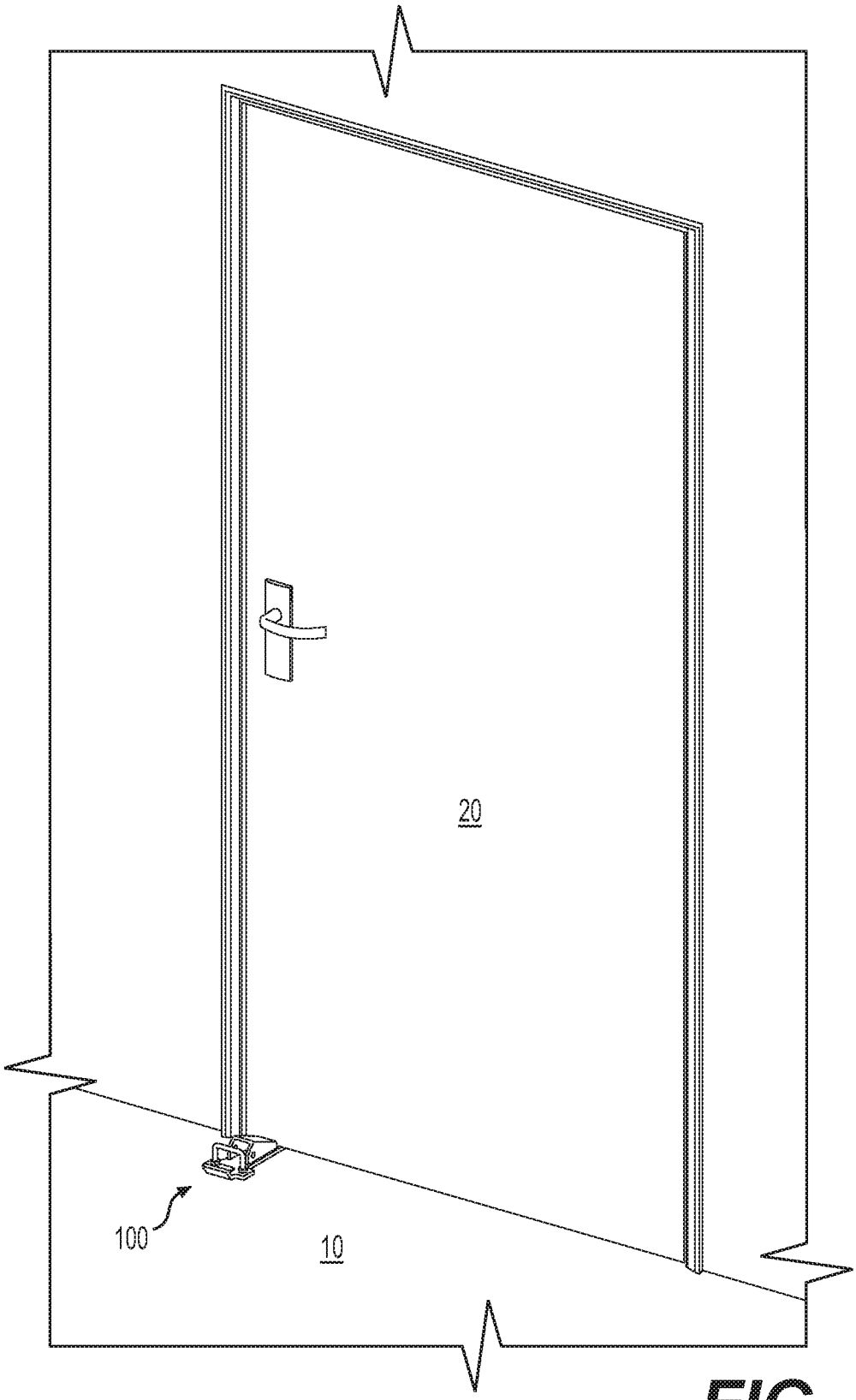
FIG. 15 is another perspective view showing the door lock of FIG. 1 engaged with the door.

FIGS. 11-15 show the door lock 100 engaging or preparing to engage with a floor surface 10 and a door 20. FIG. 11 shows the base 110 near the floor 10 and the apertures 12, 16. As shown in FIG. 12, the door lock 100 is lowered the floor 10, preferably near the apertures 12, 16 in the floor surface 10. As shown in FIG. 13, to the door lock 100 is positioned so that the wedge 130 contacts the door 20 and the taper 103 is below the door 20, and the holes 112, 116 in the base 110 and the apertures 12, 16 in the floor surface 10 align. The pins 152, 154 can then be inserted through the holes 112, 116 and the apertures 12, 16 to secure the base 110 into position against the closed door 20 (FIGS. 14 and 15). The steel sleeves may further reinforce the receiving point of the pins 152, 154. When engaged, the position of the door lock 100 against the door 20 may provide added stability against dislodging or a potential unauthorized entrance into a room.

The illustrated base engaging end 106 is wider than the base abutting end 102. The placement of the holes 112, 116 in the base engaging end 106 to be used in connection with corresponding pins 152, 154 contributes to increase stability and immobility of the base 110. Having a wider base engaging end 106 allows placement of the dual holes 112, 116 to be further apart, which may provide added strength to the pins 152, 154, and thereby added immobility to the door lock 100 while it is engaged. Specifically, the widened base engaging end 106 and the dual pins 152, 154 engaged with the base holes 112, 116 may prevent the base 110 from undergoing any pivoting motion. Thus, a person seeking unauthorized entrance into a room may not be able to move or pivot the wedge 130 from the door 20 and thereby dislodge the door lock 100. It is foreseen that the number of holes also contributes to the stability and immobility of door lock 100.

Figure 16:
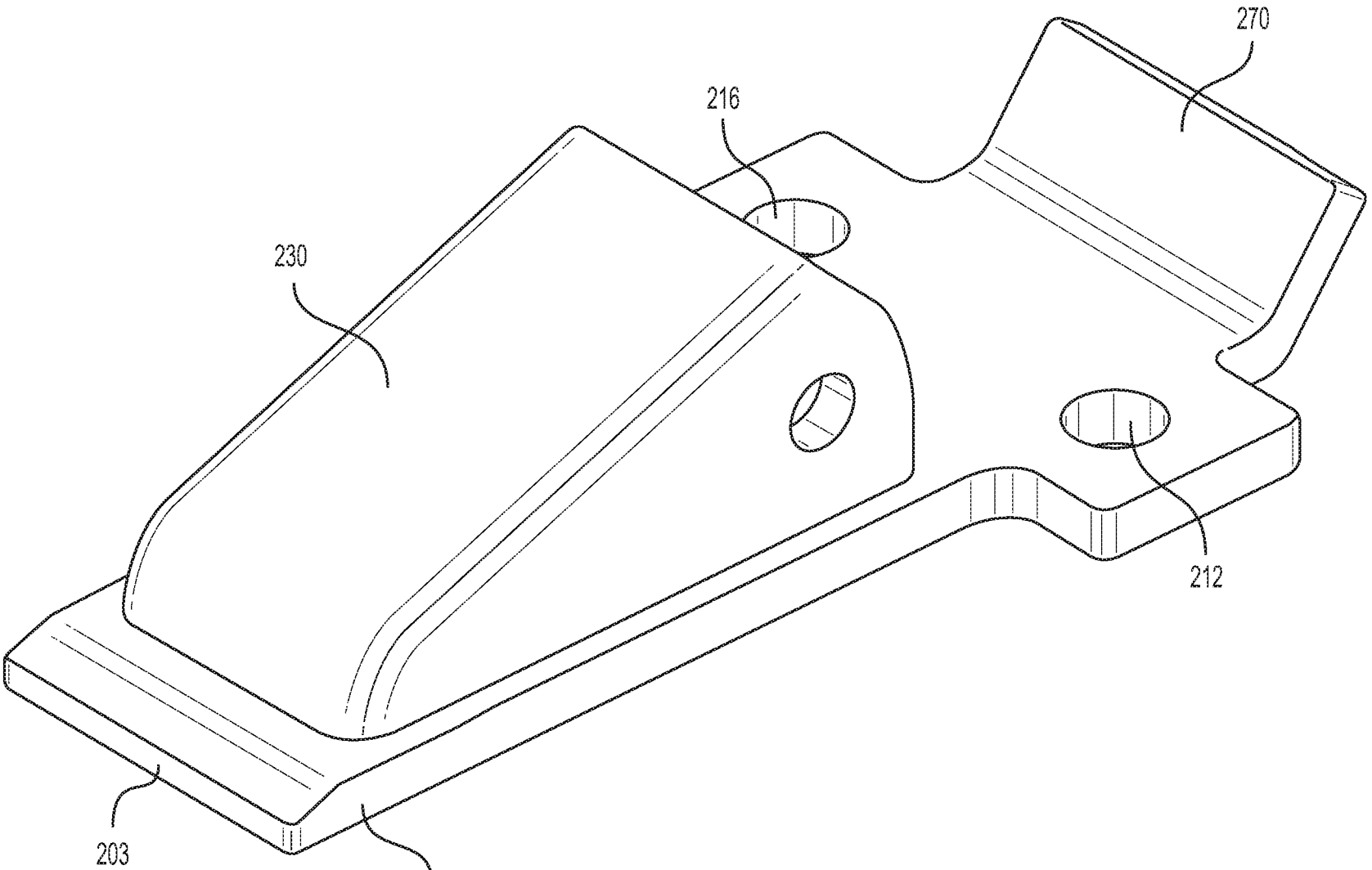
FIG. 16 is a perspective view of another embodiment of a door lock.

FIG. 16 shows another door lock 200 that is substantially similar to the door lock 100, except as specifically noted and/or shown, as would be inherent. Further, those skilled in the art will appreciate that the door lock 100 (and thus the door lock 200) may be modified in various ways, such as incorporating all or part of any of the various described embodiments, for example. For uniformity and brevity, reference numbers between 200 and 299 may be used to indicate parts corresponding to those discussed above numbered between 100 and 199 (e.g., base 210 corresponds general to the base 110), though with any noted or shown deviations.

The door lock 200 has a base 210 that has an abutting end 202 that is less than an inch in length as it extends from a tapered end 236 of a wedge 230. A shortened abutting end 202 may be preferable if the door 20 has a threshold or extends very near to the floor 10.

Figure 17:
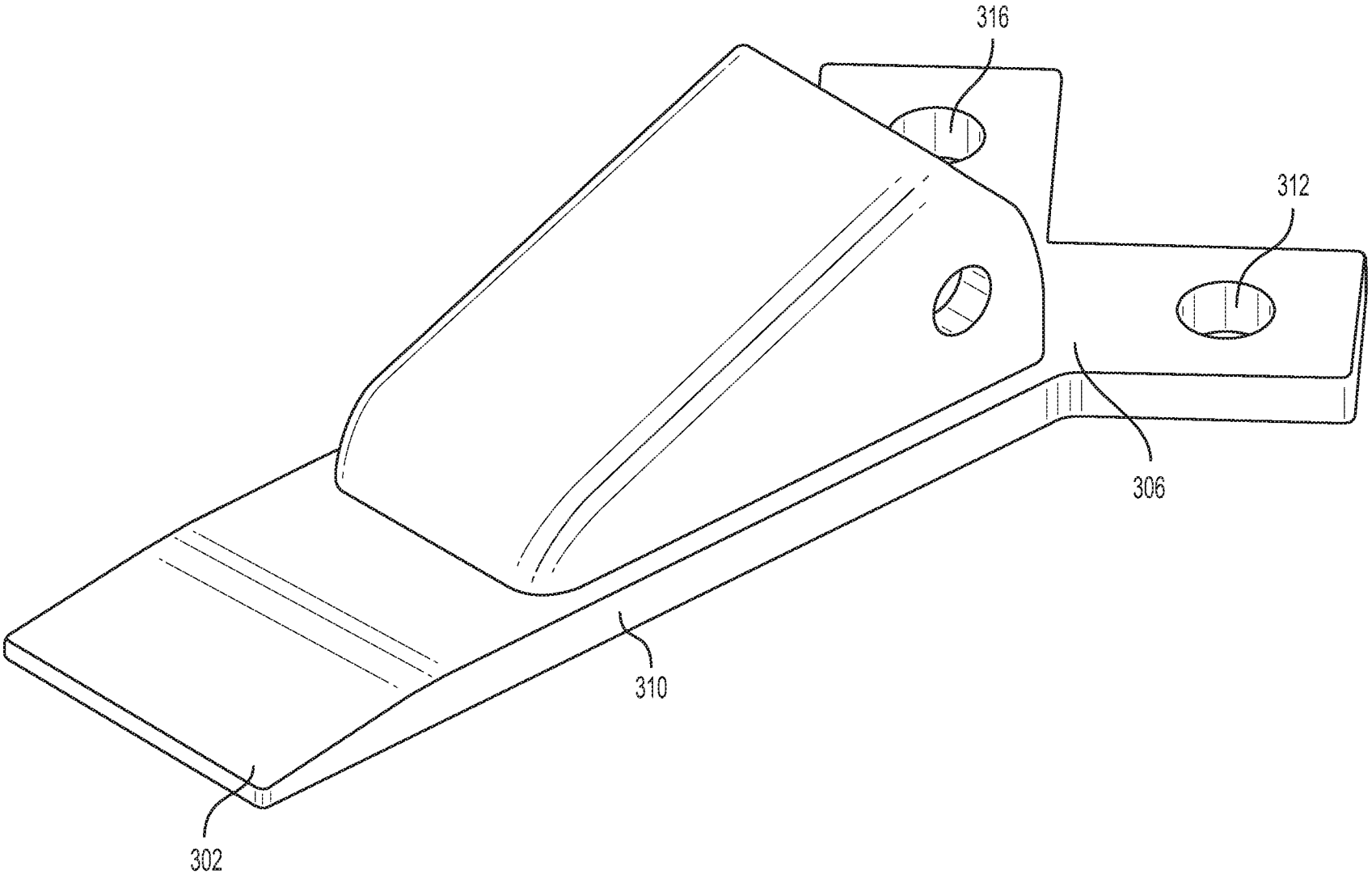
FIG. 17 is a perspective view of still another embodiment of a door lock.

FIG. 17 shows another door lock 300 that is substantially similar to the door lock 100, except as specifically noted and/or shown, as would be inherent. Further, those skilled in the art will appreciate that the door lock 100 (and thus the door lock 300) may be modified in various ways, such as incorporating all or part of any of the various described embodiments, for example. For uniformity and brevity, reference numbers between 300 and 399 may be used to indicate parts corresponding to those discussed above numbered between 100 and 199 (e.g., base 310 corresponds general to the base 110), though with any noted or shown deviations.

The door lock 300 has a base 310 that has an engaging end 306 is V-shaped. Two holes 312, 316 are disposed in the base engaging end 306. The holes 312, 316 may be preferably disposed on each end of the V.

Figure 18:
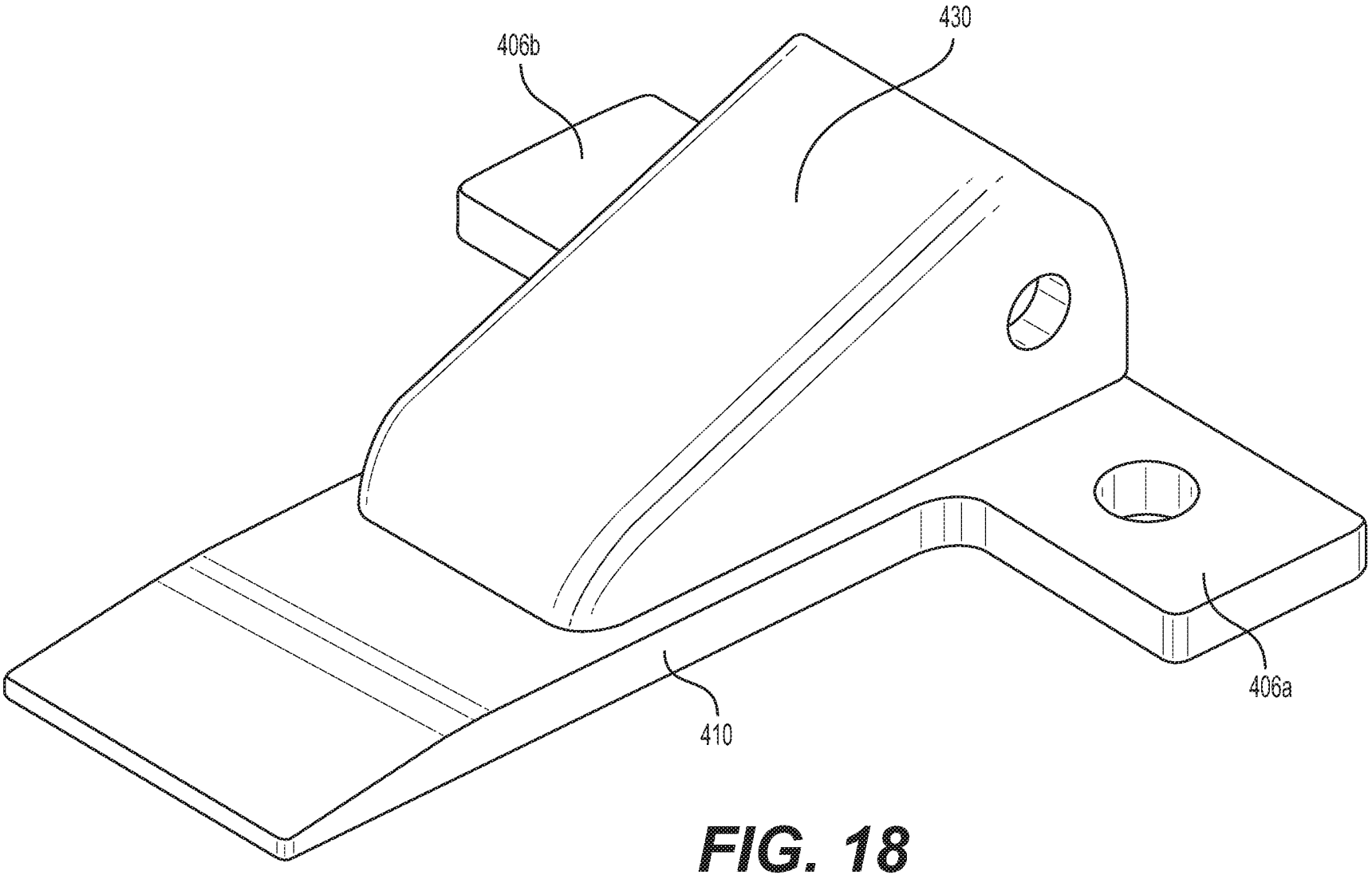
FIG. 18 is a perspective view of yet another embodiment of a door lock.

FIG. 18 shows another door lock 400 that is substantially similar to the door lock 100, except as specifically noted and/or shown, as would be inherent. Further, those skilled in the art will appreciate that the door lock 100 (and thus the door lock 400) may be modified in various ways, such as incorporating all or part of any of the various described embodiments, for example. For uniformity and brevity, reference numbers between 400 and 499 may be used to indicate parts corresponding to those discussed above numbered between 100 and 199 (e.g., base 410 corresponds general to the base 110), though with any noted or shown deviations.

The door lock 400 has a base 410 that has two engaging ends 406*a*, 406*b*. The engaging ends 406*a*, 406*b* are lateral a wedge 430.

Figure 19:
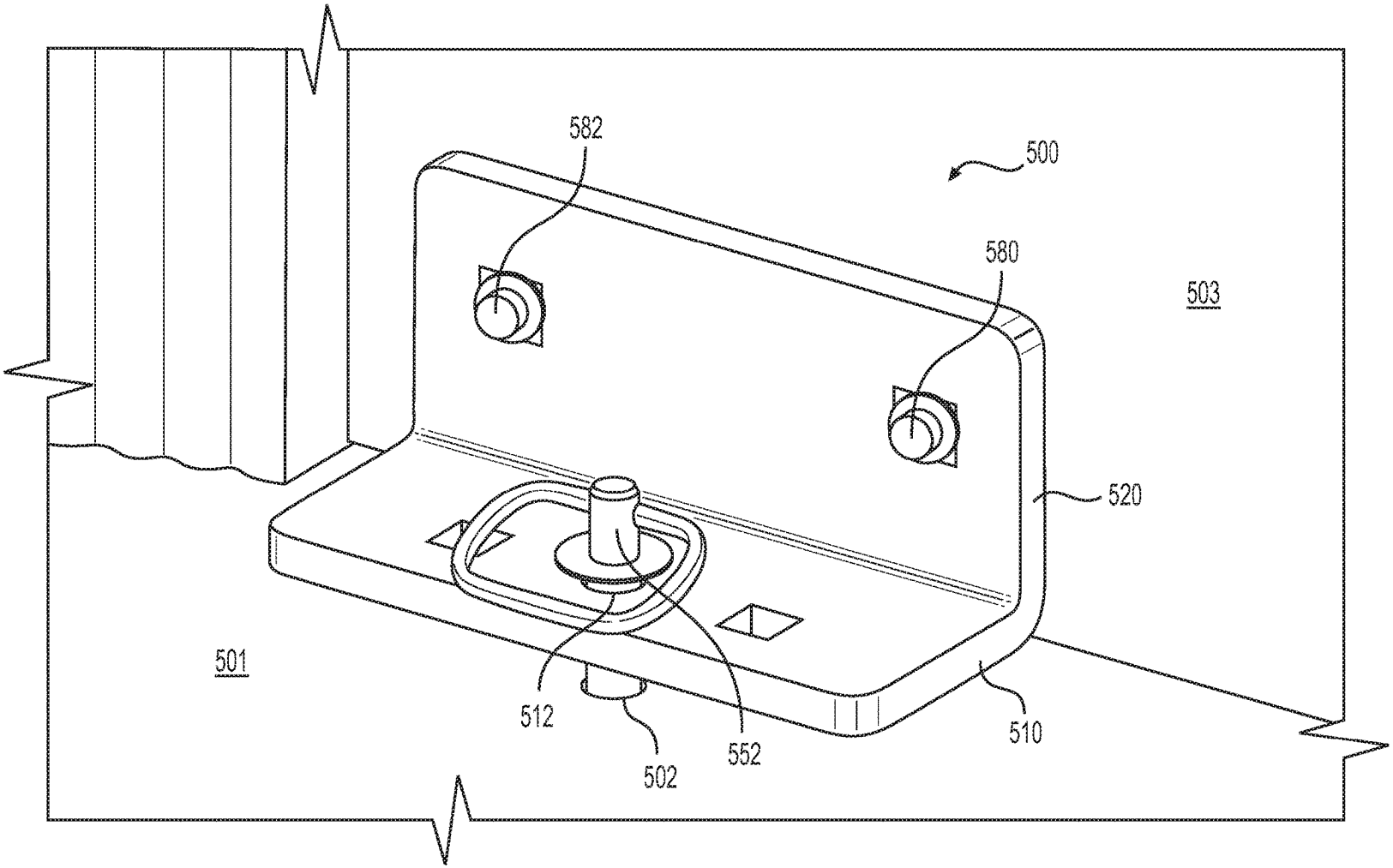
FIG. 19 is a perspective view of still yet another embodiment of a door lock engaged with a door and the floor.
Figure 20:
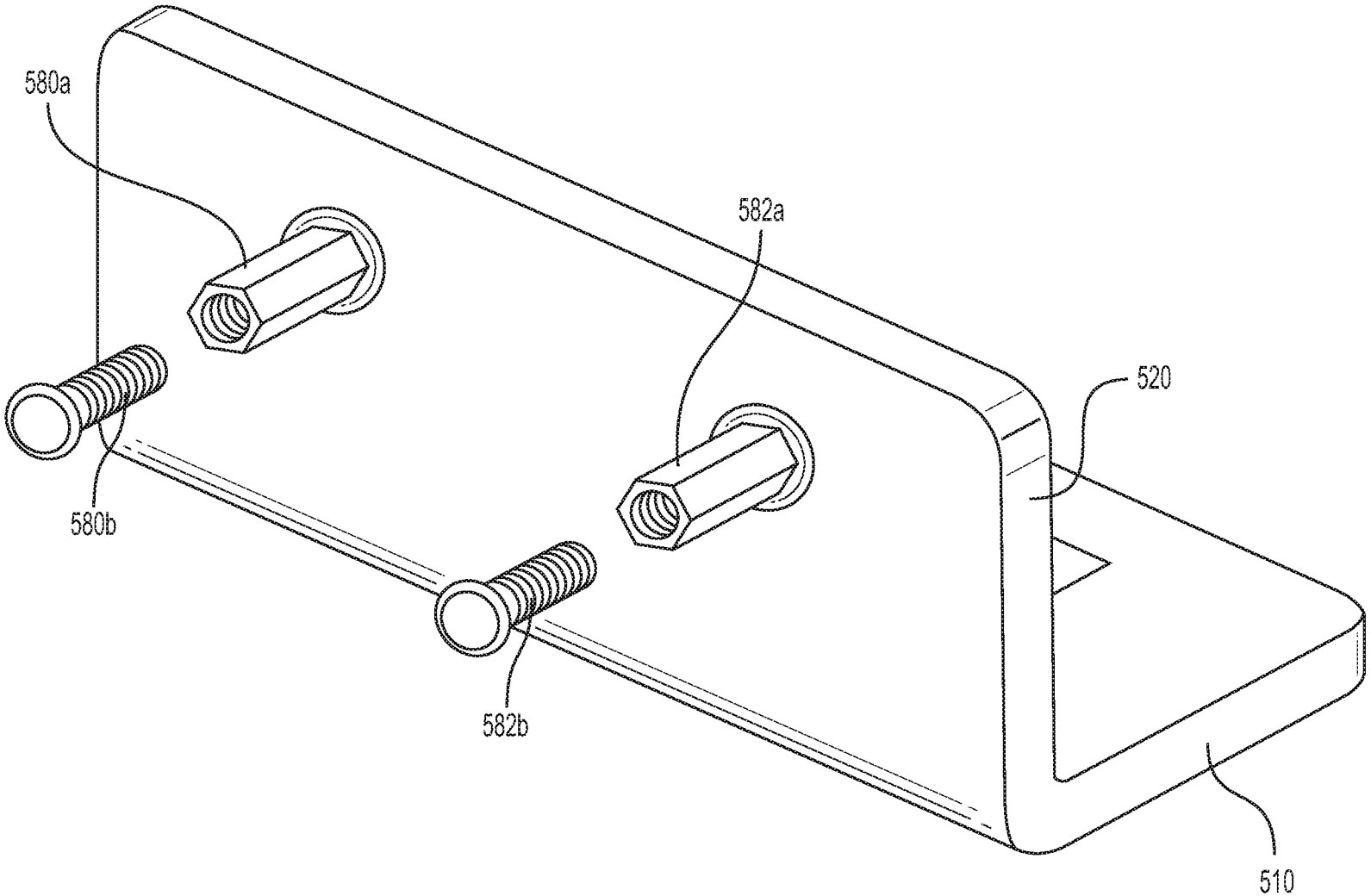
FIG. 20 is a perspective view of a back of the door lock of FIG. 19.
Figure 21:
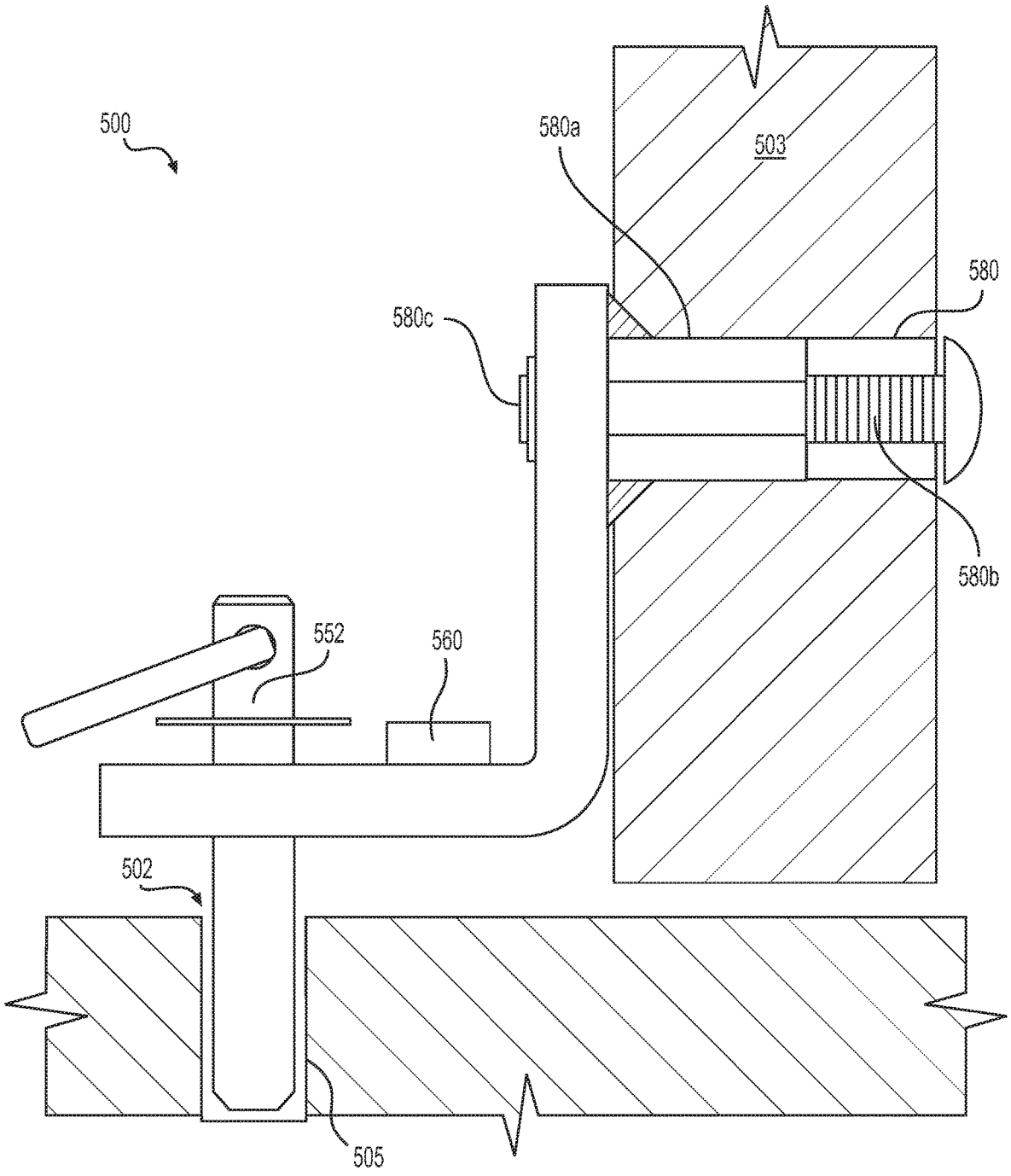
FIG. 21 is a sectional view of the embodiment of FIG. 19, shown engaged with the door and the floor surface.
Figure 22:
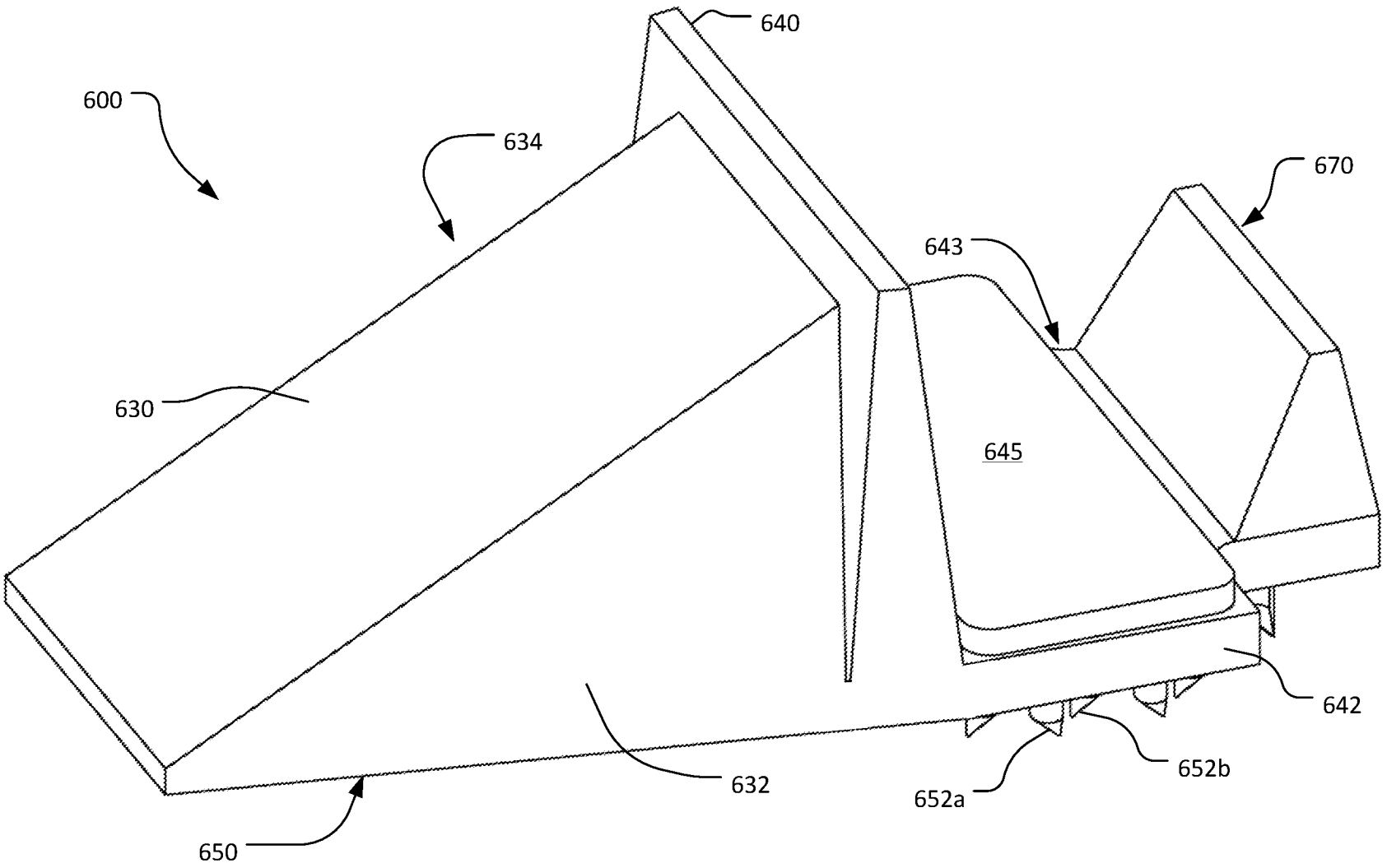
FIG. 22 is a top perspective view of door lock according to another embodiment of the invention.
Figure 23:
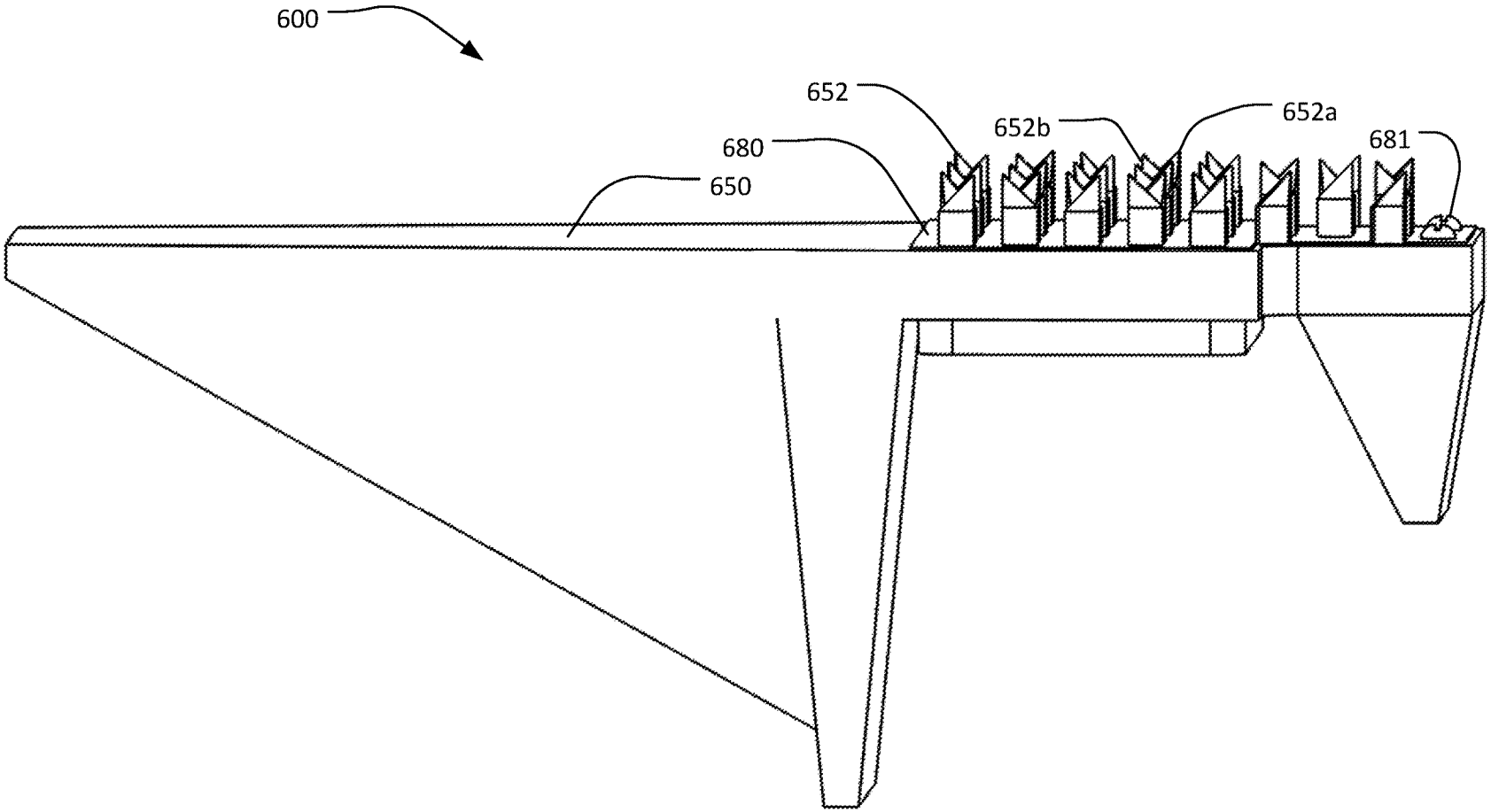
FIG. 23 is a side view of the door lock of FIG. 22.

The embodiments previously discussed are portable, wedge-shaped embodiments that are not intended to be continuously engaged with the door 20. As shown in FIGS. 19-21, another embodiment of a door lock 500 is permanently attached to a door 503. The door lock 500 has a floor engaging member 510, an upright member 520, a pin 552, and a hole 512. The door lock 500 may also have a magnet 560 fixed to the floor engaging member 510. As shown in FIG. 21, the magnet 560 may be fixed to the floor engaging member 510 near the upright member 520. The magnet 560 may alternately abut the upright member 520, or may be spaced closer to the hole 512. The magnet 520 may be used to bias the pin 552 to the floor engaging member 510 using a magnetic field when the pin 552 is not engaged with the floor surface 501; this may allow for easy storage of the pin 552. The magnetic field caused by the magnet 520 may also interact with the pin 552 and bias the pin 552 to the floor engaging member 510 while the pin 552 passes through the hole 512 and engages the floor engaging member 510 to the floor surface 501. The magnet 560 may be round, square, rectangular, triangular, or any other desired shape. The magnet 560 may be attached to the floor engaging member 510 by adhesive, bolting, welding, or any appropriate method known in the art.

It may be desirable for the door lock 500 to only have one pin 552 because the benefits associated with dual pins as mentioned in the previously discussed embodiments do not apply to the fixed door lock 500 as there is no risk of dislodging the door lock 500 by pivoting. A single pin 552 may reduce the potential for misalignment between the hole 512 and a floor aperture 502. Further, use of a single pin 552 may increase ease of use and decrease an amount of time needed to engage the door lock 500.

As shown in FIG. 19, the door lock 500 is bolted to the door 503 by attachment members 580, 582. It is foreseen that the door lock 500 may be attached to the door by other means, i.e. fasteners, bolts, screws, or other means known in the art. Referring to FIG. 20, couplers 580*a*, 582*a* extend from a back of the upright member 520. The couplers 580*a*, 582*a* may be constructed of any appropriate material, such as steel, aluminum, and other materials and composites. The couplers 580*a*, 582*a* may be attached to the upright member 510 (e.g., by adhesive, welding, bolting, etc.) or may be formed integrally with the upright member 510. The couplers 580*a*, 582*a* may be threaded and configured to receive bolts 580*b*, 582*b*.

Referring to FIG. 21, when engaged, the pin 552 is inserted through the hole 512 and into the aperture 502 in the floor surface 501 to lock the door 503 in place. A steel sleeve may be placed in the floor aperture 502 to secure the aperture 502 and provide an interior for engaging with the pin 552. The steel sleeve may further aid in keeping the pin 552 secure when engaged with a floor surface 501. The steel sleeve may interact with a cover when the pin 552 is not engaged to keep dirt and debris from entering the interior.

The attachment members 580, 582 may extend through a width of the door 503. The door lock 500 is attached to the door 503 by the couplers 580*a*, 582*a* and bolts 580*b*, 582*b*. The bolts 580*b*, 582*b* may be tamper resistant. Use of tamper resistant bolts 580*b*, 582*b* reduces a risk that the door lock 500 may be removed by an intruder. The couplers 580*a*, 582*a* are generally parallel to one another, and are generally perpendicular to the upright member 520. The couplers 580*a*, 582*a* may extend between one and three inches from the upright member 520. It is foreseen that attachment members 580, 582 may not extend through the width of the door 503.

FIGS. 22-25 illustrate another embodiment of a door lock 600. The door lock 600 may be substantially similar to the door locks 100, 200, 300, 400, and/or 500, except as shown and described herein or as may be inherent. Further, those skilled in the art will appreciate that the embodiment 600 (and thus embodiments 100-500) may be modified in various ways, such as through incorporating all or part of any of the various described embodiments, for example. For uniformity and brevity, reference numbers 600-699 may be used to indicate parts corresponding to those discussed above numbered between 100-199 (e.g., wedge 630 corresponds generally to wedge 130), though with any noted or shown deviations. As will be described in greater detail below, among other differences, the door lock 600 may be configured to temporarily attach to the floor without requiring an external fastening mechanism, such as a bolt.

Figure 26:
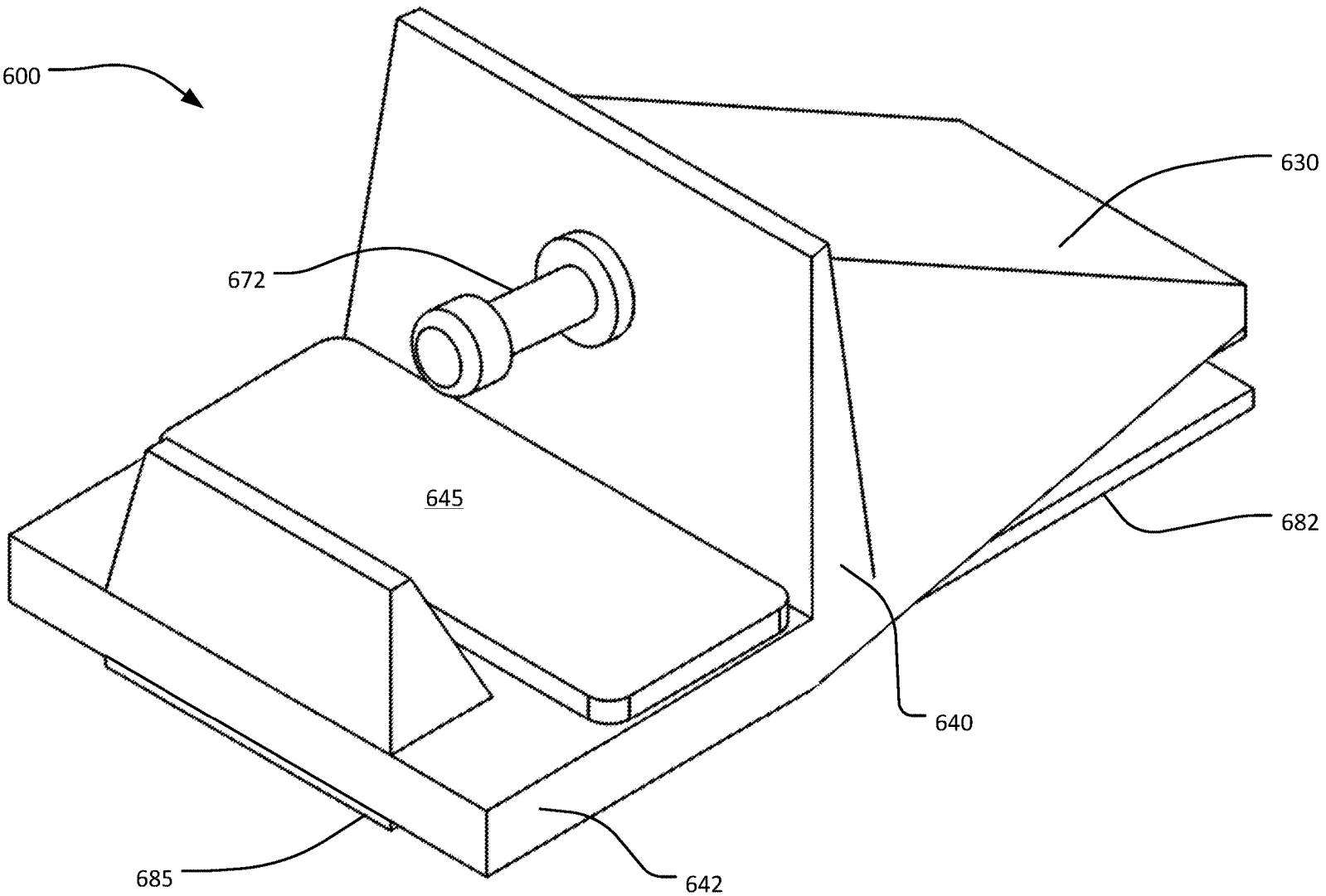
FIG. 26 is a top perspective view of a door lock according to still another embodiment of the invention.

The door lock 600 may define a wedge 630 having opposing sides 632 and 634. The opposing sides 632 and 634 may be angled outwardly towards the bottom of the wedge 630. The wedge 630 terminates in a substantially vertical wall 640. The wall 640 may extend upwardly beyond a top of the wedge 630, and outwardly beyond the respective opposing sides 632 and 634. The wall 640 extends into a horizontal member 642, which terminates in a handle 670 extending upwardly from the horizontal member 642 as shown. The base member 642 may extend under and around the handle 670 (FIG. 22), or the handle 670 may extend from the horizontal member 642 (FIG. 26). In any event, an area 643 is defined at the base member 642 between the wall 640 and the handle 670.

Figure 24:
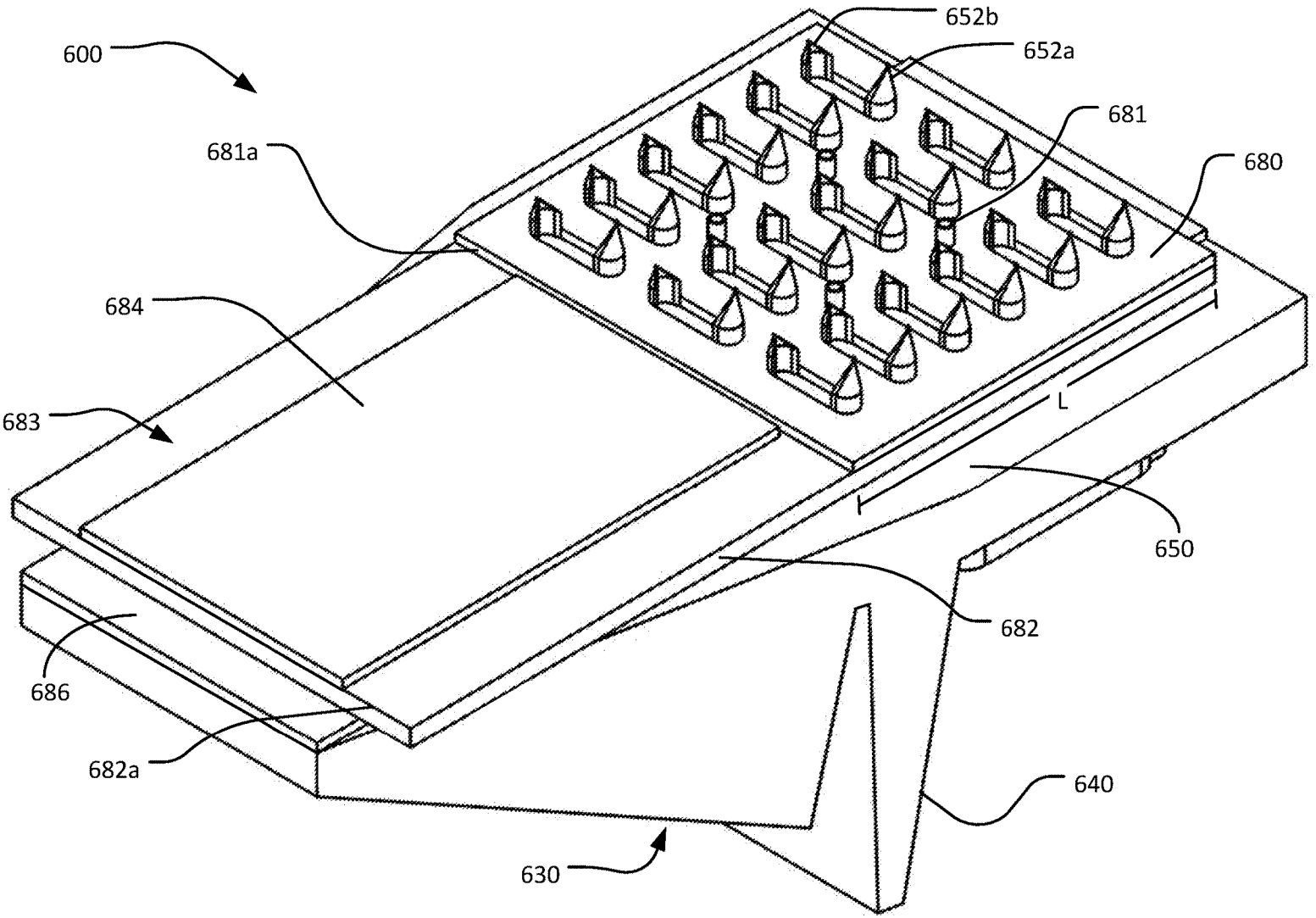
FIG. 24 is a bottom perspective view of the door lock of FIG. 22.
Figure 28:
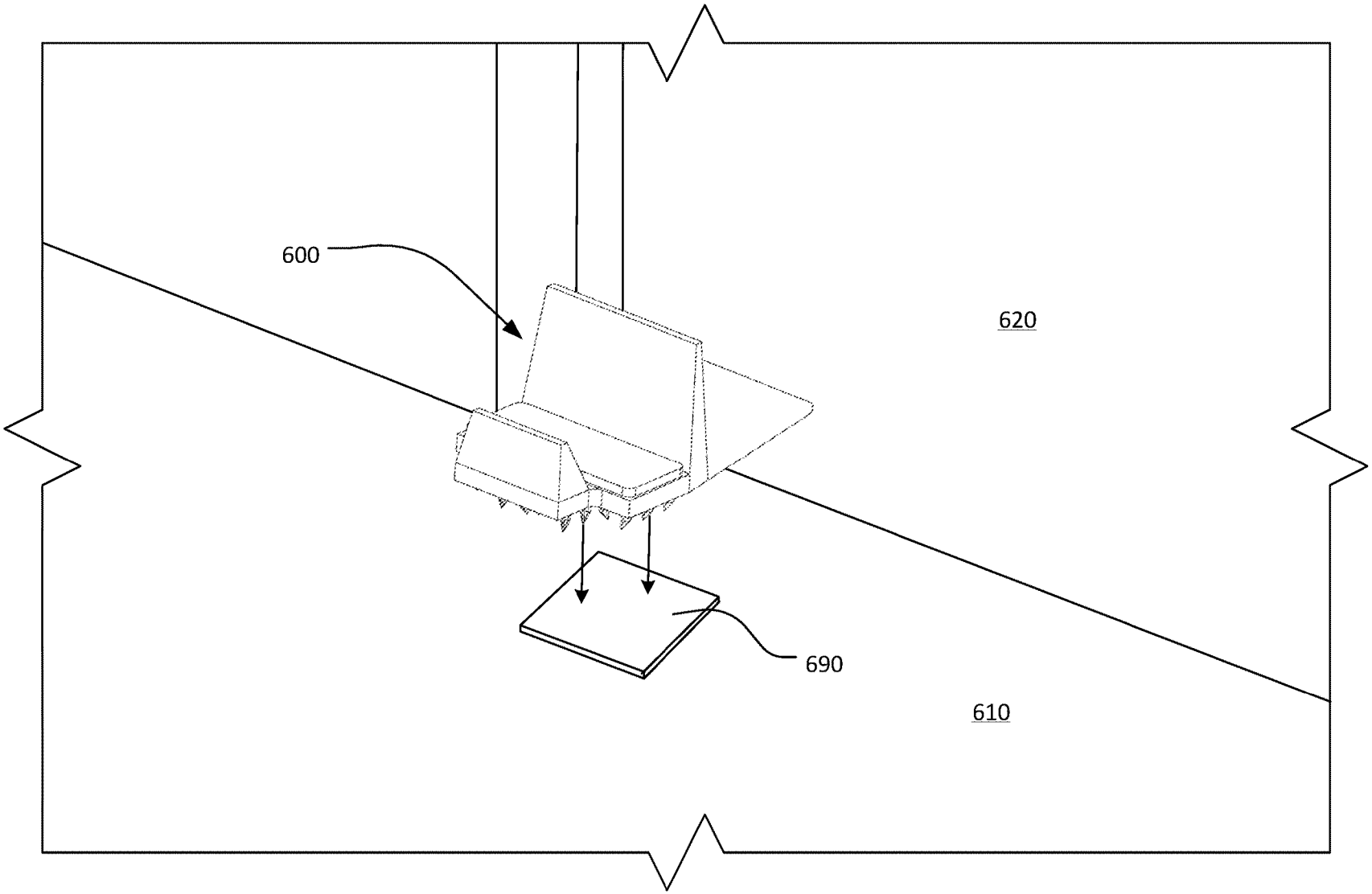
FIG. 28 shows a perspective view of a grip pad adhered to a floor for use with a door lock according to various embodiments of the invention.

Referring now to FIG. 24, the door lock 600 forms a generally planar bottom surface 650. The bottom surface 650 is configured to lay substantially flat against a floor surface 610 (FIG. 28). In order to prevent the door lock 600 from sliding against the floor surface 610, the bottom surface 650 may include means for engaging with the floor surface 610. The bottom surface 650 includes a plurality of spikes 652. The spikes 652 may be oriented in one or more directions (e.g., a forward direction 652*a* and a backward direction 652*b*) to prevent the door lock 600 from sliding either forward or backward when engaged with the floor surface 610. In some embodiments, the spikes 652 may be defined into the bottom surface 650 of the door lock 600, while in other embodiments, the spikes 652 may be defined into a projection member 680. The projection member 680 may be removably attached to the bottom surface 650 of the door lock 600 with fasteners 681 such as screws, bolts, rivets, et cetera. Adhesive may additionally be placed between a top surface of the projection member 680 and the bottom surface 650 of the door lock 600 to further secure the projection member 680 to the bottom surface 650 of the door lock 600.

Figure 25:
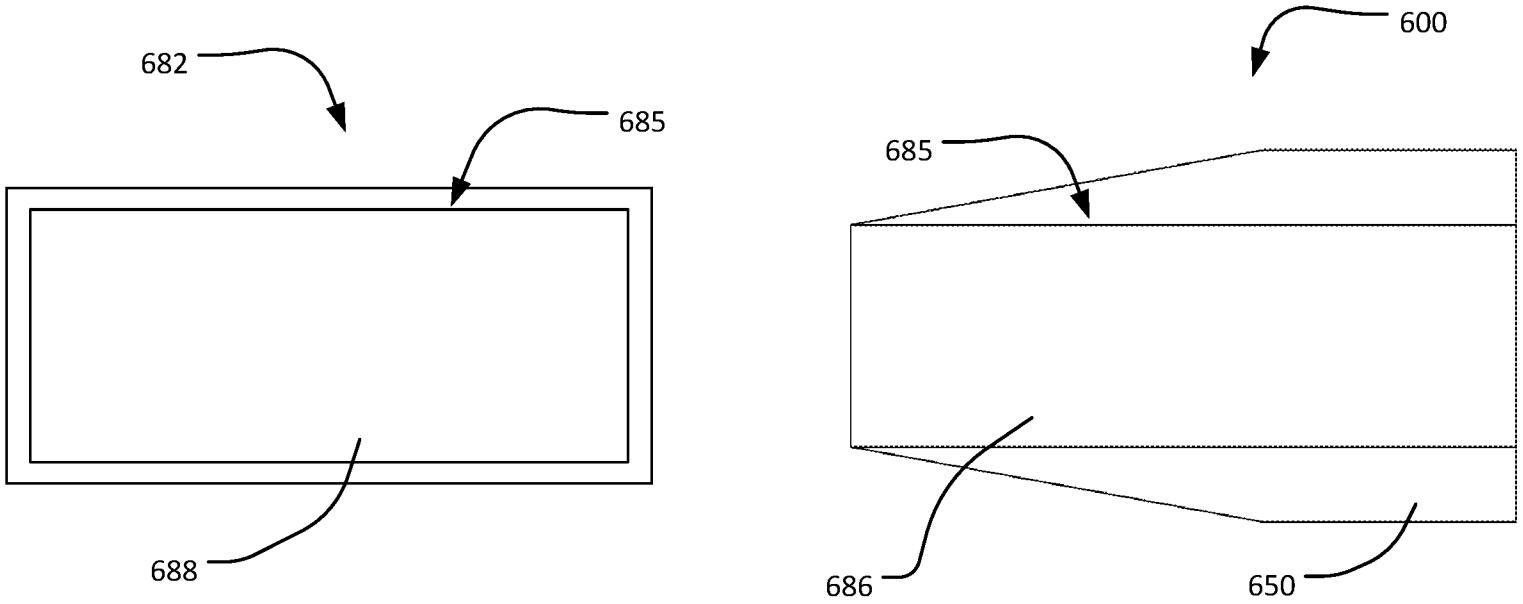
FIG. 25 shows respective top and bottom views of an engagement panel and a door lock prior to adhering the engagement panel to the door lock.

Referring now to FIGS. 25-26, in some embodiments, the projection member 680 may be attached to a bottom side of an engagement panel 682 with fasteners 681, e.g., via screws, bolts, rivets, et cetera, such that the spikes 652 extend away from the engagement panel 682. The projection member 680 may extend along a length L of the engagement panel 682. In some embodiments, the projection member 680 extends along less than half of the length L of the engagement panel 682, leaving an area 683 between an inside edge 681*a* of the projection member 680 and an edge of the 682*a* of engagement panel 682.

The engagement panel 682 may be removably or permanently attached to the bottom surface 650 of the door lock 600. In embodiments, the bottom surface 650 of the door lock 600 and the top surface of the engagement panel 682 may be prepared with respective opposing temporary fastening mechanisms 685. For example, hook-and-loop fasteners may be utilized to temporarily attach the engagement panel 680 to the door lock 600. A section of fabric featuring hooks 686 may be adhered to the bottom surface 650, while a section of fabric featuring loops 688 may be adhered to the top surface of the engagement panel 680, or vice versa. When brought together, the engagement panel 680 adheres to the bottom surface 650. Spikes 652 may be defined in a bottom side of the engagement panel 682 opposite the surface with the fastening mechanism 685.

In some embodiments, a strip of sand paper 684 may be adhered to the engagement panel 682 in the area 683 between the edge of the projection member 681*a* and the edge 682*a* of the engagement panel 682. The sand paper 684 may provide additional resistance against movement of the door lock 600 by catching on the carpeting or grip pad 690 (described below) when pressure is applied to the door lock 600.

Figure 27:
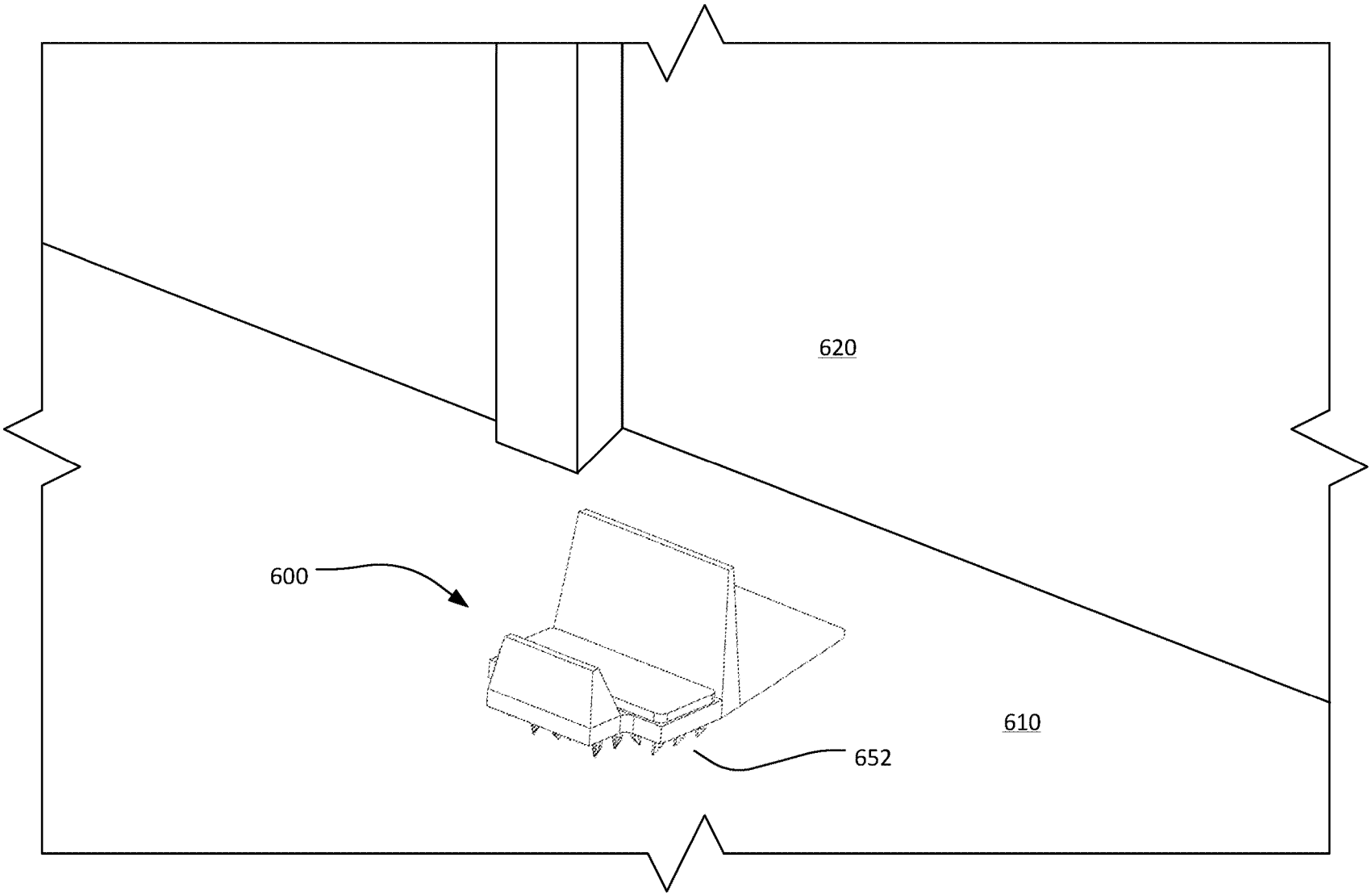
FIG. 27 shows a perspective view of a door lock in use according to various embodiments of the invention.

In some embodiments, as shown in FIG. 27, a knob 672 may extend from the wall 640 into the area 643. As described above, spikes 652 extend from the door lock 600, which may cause injury to a user if the door lock 600 is not appropriately handled. Accordingly, the knob 672 may allow a user to easily pick up and/or move the door lock 600 without requiring the user to place his or her fingers under the door lock 600 and in the way of the spikes 652.

In some embodiments, a textile piece 645 may be adhered to the base member 642 between the wall 640 and the handle 670. The textile piece 645 may cover the base member 642, and specifically, areas on the base member 642 that may be hazardous to a user as the user places or moves the door lock 600. For example, holes may be drilled into the base member 642 for receiving the fastening members 681 to secure the projection member 680 to the door lock 600 as described below. The textile piece 645 may therefore cover the holes and prevent the user's fingers from coming into contact with the holes and/or the ends of the fastening members 681. Further, the textile piece 645 may provide a cushion for a user's fingers when engaging with the grip 672, and specifically when the user presses the door lock 600 into the carpeting or grip pad as described below.

With reference now to FIG. 28, in use, the door lock 600, and specifically the spikes 652 of the projection member 680, are configured to engage with a textile area on the floor surface 610 near a door 620 to prevent the door 620 from opening. The door lock 600 may be placed on the floor 610 inward (i.e., in the direction of the center of the door 620) from the swinging edge of the door 620, on the side of the door 620 in the direction of the door's travel.

In some embodiments, the floor surface 610 is carpeting. If the carpeting is substantially fixed (e.g., not a movable rug), then the door lock 600 is placed on the floor surface 610 against the door 620 (or the threshold of the door 620), and the door lock 600 is pushed into the floor surface 610 such that the spikes 652 engage with the carpet. In other embodiments, the floor surface 610 is a smooth surface, such as wood, tile, concrete, et cetera. Here, as shown in FIG. 29, the floor surface 610 may be prepped to receive the door lock 600 by cleaning an area of the floor surface 610 where the door lock 600 is to be placed. Once the floor surface 610 is clean, a grip pad 690 may be placed on the floor surface 610. The grip pad 690 may be, for example, a section of carpet, foam, foam with hook fabric, plastic, or any other textile that can engage with the spikes 652. The grip pad 690 may include a layer of adhesive for securing the grip pad 690 to the floor surface 610. Once the grip pad 690 is secured to the floor surface 610, the door lock 600 may be positioned at the floor surface 610 such that the spikes 652 engage with the grip pad 690 such that the door lock 600 is prevented from moving forward or backward, thereby preventing the door 620 from opening.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Various steps in describing methods may be undertaken simultaneously or in other orders than specifically provided.

The invention claimed is:

1. A door lock, comprising:
- a bottom surface;
- a wedge portion extending upward from the bottom surface at a first end thereof, the wedge portion comprising:
  - an angled top surface;
  - opposing angled sides extending from the angled top surface to the bottom surface; and
  - a substantially vertical back wall;
- a horizontal member extending perpendicularly from the back wall;
- a handle extending upwardly from the horizontal member at an end thereof; and
- a projection member secured to the bottom surface, the projection member comprising a plurality of spikes defined therein and extending from a first side of the projection member in a direction away from the bottom surface;

wherein:
- the projection member is secured to a first side of an engagement panel with at least one fastener;
- a second side of the engagement panel and the bottom surface of the door lock respectively comprise corresponding fastening apparatus for temporarily securing the engagement panel to the bottom surface of the door lock;
- the engagement panel is secured to the bottom surface of the door lock such that the spikes extend away from the bottom surface of the door lock; and
- the corresponding fastening apparatus together form a hook-and-loop type fastener.

2. The door lock of claim 1, wherein the projection member is secured to the bottom surface of the door lock at a second end of the wedge portion, the second end being spaced apart from the first end.

3. The door lock of claim 1, wherein the engagement panel further comprises a strip of sandpaper adhered to the first side thereof in an area devoid of the projection member.

4. The door lock of claim 1, wherein a first portion of the plurality of spikes each has a spiked edge angled in a first direction, and a second portion of the plurality of spikes each has a spiked edge angled in an opposing second direction.

5. The door lock of claim 1, further comprising a knob extending into an area defined between the vertical wall, the horizontal member, and the handle.

6. The door lock of claim 5, further comprising a pad adhered atop the horizontal member between the vertical wall and the handle.

7. The door lock of claim 1, further comprising a pad adhered atop the horizontal member between the vertical wall and the handle.

8. A door lock, comprising:
- a bottom surface;
- a wedge portion extending upward from the bottom surface, the wedge portion comprising:
  - an angled top surface; and
  - opposing angled sides extending from the angled top surface to the bottom surface; and
- a projection member secured to the bottom surface, the projection member comprising a plurality of spikes defined therein and extending from a first side of the projection member in a direction away from the bottom surface;

wherein:
- the projection member is secured to a first side of an engagement panel with at least one fastener;
- a second side of the engagement panel and the bottom surface of the door lock respectively comprise corresponding fastening apparatus for temporarily securing the engagement panel to the bottom surface of the door;
- the engagement panel is secured to the bottom surface of the door lock such that the spikes extend away from the bottom surface of the door lock; and
- the corresponding fastening apparatus together form a hook-and-loop type fastener.

9. The door lock of claim 8, wherein the projection member is secured to the bottom surface at an end opposite the wedge portion.

10. A door lock, comprising:
- a bottom surface;
- a wedge portion extending upward from the bottom surface at a first end thereof, the wedge portion comprising:
  - an angled top surface;
  - opposing angled sides extending from the angled top surface to the bottom surface; and
  - a substantially vertical back wall;
- a horizontal member extending perpendicularly from the back wall;
- a handle extending upwardly from the horizontal member at an end thereof; and
- a projection member secured to the bottom surface, the projection member comprising a plurality of spikes defined therein and extending from a first side of the projection member in a direction away from the bottom surface;

wherein:
- the projection member is secured to a first side of an engagement panel with at least one fastener;
- a second side of the engagement panel and the bottom surface of the door lock respectively comprise corresponding fastening apparatus for temporarily securing the engagement panel to the bottom surface of the door;

the engagement panel is secured to the bottom surface of the door lock such that the spikes extend away from the bottom surface of the door lock; and the engagement panel further comprises a strip of sandpaper adhered to the first side thereof in an area devoid of the projection member.

11. The door lock of claim 10, wherein a first portion of the plurality of spikes each has a spiked edge angled in a first direction, and a second portion of the plurality of spikes each has a spiked edge angled in an opposing second direction.

12. The door lock of claim 8, wherein a first portion of the plurality of spikes each has a spiked edge angled in a first direction, and a second portion of the plurality of spikes each has a spiked edge angled in an opposing second direction.

13. The door lock of claim 8, further comprising a knob extending from the wedge portion.

14. The door lock of claim 13, further comprising a handle.

15. The door lock of claim 8, further comprising a handle.

16. The door lock of claim 10, further comprising a knob extending into an area defined between the vertical wall, the horizontal member, and the handle.

17. The door lock of claim 10, further comprising a pad adhered atop the horizontal member between the vertical wall and the handle.

* * * * *